US009243306B2

(12) United States Patent
Kanno et al.

(10) Patent No.: US 9,243,306 B2
(45) Date of Patent: Jan. 26, 2016

(54) FERRITIC STAINLESS STEEL SHEET EXCELLENT IN OXIDATION RESISTANCE

(75) Inventors: Norihiro Kanno, Tokyo (JP); Yoshiharu Inoue, Tokyo (JP); Junichi Hamada, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 634 days.

(21) Appl. No.: 13/583,700

(22) PCT Filed: Mar. 11, 2011

(86) PCT No.: PCT/JP2011/056480

§ 371 (c)(1),
(2), (4) Date: Sep. 10, 2012

(87) PCT Pub. No.: WO2011/111871

PCT Pub. Date: Sep. 15, 2011

(65) Prior Publication Data

US 2013/0004360 A1 Jan. 3, 2013

(30) Foreign Application Priority Data

Mar. 11, 2010 (JP) ..... 2010-054796
Nov. 29, 2010 (JP) ..... 2010-265015

(51) Int. Cl.

| | |
|---|---|
| ***C22C 38/22*** | (2006.01) |
| ***C22C 38/26*** | (2006.01) |
| ***C22C 38/20*** | (2006.01) |
| ***C21D 9/46*** | (2006.01) |
| ***C22C 38/00*** | (2006.01) |
| ***C22C 38/02*** | (2006.01) |

(Continued)

(52) U.S. Cl.

CPC *C21D 9/46* (2013.01); *C21D 6/002* (2013.01); *C22C 38/001* (2013.01); *C22C 38/004* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C21D 2211/005* (2013.01)

(58) Field of Classification Search

None

See application file for complete search history.

(56) References Cited

U.S. PATENT DOCUMENTS

| | | | |
|---|---|---|---|
| 2009/0120536 | A1 | 5/2009 | Tomita et al. |
| 2010/0050617 | A1 | 3/2010 | Oku et al. |

FOREIGN PATENT DOCUMENTS

| | | |
|---|---|---|
| EP | 0 478 790 | 4/1992 |
| JP | 05-331551 | 12/1993 |

(Continued)

OTHER PUBLICATIONS

International Search Report dated Jun. 14, 2011, issued in corresponding PCT Application No. PCT/JP2011/056480.

*Primary Examiner* — Deborah Yee

(74) *Attorney, Agent, or Firm* — Kenyon & Kenyon LLP

(57) ABSTRACT

Ferritic stainless steel sheet which has a high oxidation resistance and scale spallation resistance even at a high temperature near 1000° C., characterized by containing C: 0.020% or less, N: 0.020% or less, Si: over 0.10 to 0.35%, Mn: 0.10 to 0.60%, Cr: 16.5 to 20.0%, Nb: 0.30 to 0.80%, Mo: over 2.50 to 3.50%, and Cu: 1.00 to 2.50%, having an amount of increase of oxidation after a continuous oxidation test in the air at 1000° C. for 200 hours of 4.0 mg/cm$^2$ or less, and having an amount of scale spallation of 1.0 mg/cm$^2$ or less.

2 Claims, 5 Drawing Sheets

(51) Int. Cl.

| | |
|---|---|
| ***C22C 38/04*** | (2006.01) |
| ***C22C 38/28*** | (2006.01) |
| ***C22C 38/32*** | (2006.01) |
| ***C21D 6/00*** | (2006.01) |
| ***C22C 38/06*** | (2006.01) |

(56) References Cited

FOREIGN PATENT DOCUMENTS

| | | |
|---|---|---|
| JP | 06/002036 | 1/1994 |
| JP | 08-049050 | 2/1996 |
| JP | 2696584 | 9/1997 |
| JP | 2007-016311 | 1/2007 |
| JP | 2008-189974 | 8/2008 |
| JP | 2009-1834 | 1/2009 |
| JP | 2009-120893 | 6/2009 |
| JP | 2009-120894 | 6/2009 |
| JP | 2009-174036 | 8/2009 |
| JP | 2009-197306 | 9/2009 |
| JP | 2009-197307 | 9/2009 |
| JP | 2009-215648 | 9/2009 |
| JP | 2009-235555 | 10/2009 |
| JP | 2010-156039 | 7/2010 |

FERRITIC STAINLESS STEEL SHEET EXCELLENT IN OXIDATION RESISTANCE

This application is a national stage application of International Application No. PCT/JP2011/056480, filed Mar. 11, 2011, which claims priority to Japanese Application Nos. 2010-054796, filed Mar. 11, 2010, and 2010-265015, filed Nov. 29, 2010, the contents of which are incorporated by reference in their entirety.

TECHNICAL FIELD

The present invention relates to ferritic stainless steel sheet excellent in oxidation resistance which is suitable for use for exhaust system members etc. in which in particular oxidation resistance is required and to ferritic stainless steel sheet excellent in heat resistance which is suitable for use in exhaust system members etc. in which in particular thermal fatigue characteristics are required.

BACKGROUND ART

The exhaust manifolds and other exhaust system members of automobiles are run through by high temperature exhaust gas which is exhausted from the engines, so the materials which form the exhaust system members are required to exhibit high heat strength, oxidation resistance, thermal fatigue characteristics, and various other characteristics. Ferritic stainless steels which are excellent in heat resistance are used.

The exhaust gas temperature differs depending on the car model, but is usually 800 to 900° C. or so, while the temperature of exhaust manifolds through which high temperature exhaust gas which is exhausted from the engines run becomes 750 to 850° C.

Due to the recent rise in interest in environmental issues, further strengthening of exhaust gas regulations and improvement of fuel efficiency are underway. As a result, the exhaust gas temperatures may rise to close to 1000° C.

The ferritic stainless steels which have been recently used include SUS429 (Nb—Si steel) and SUS444 (Nb—Mo steel). These are based on addition of Nb and further use addition of Si and Mo so as to improve the high temperature strength and oxidation resistance.

Among stainless steels, austenitic stainless steels are excellent in heat resistance and workability. However, austenitic stainless steels are large in coefficient of thermal expansion, so when used for members such as exhaust manifolds which are repeatedly heated and cooled, thermal fatigue fracture easily occurs.

On the other hand, ferritic stainless steels are smaller in coefficient of thermal expansion compared with austenitic stainless steels, so are excellent in thermal fatigue characteristics and scale spallation resistance. Further, they do not contain Ni, so are lower in material costs compared with austenitic stainless steels and are used for general applications.

Ferritic stainless steels are lower in high temperature strength compared with austenitic stainless steels, so techniques for improving the high temperature strength have been developed.

Ferritic stainless steels which are improved in high temperature strength include, for example, SUS430J1 (Nb steel). This uses the solution strengthening or precipitation strengthening by addition of Nb so as to raise the high temperature strength.

Nb steels, however, have the problems of hardening of the finished sheets, drop in elongation, and low r-value, an indicator of deep drawability.

The hardening of the finished sheets is a phenomenon where the presence of solute Nb or precipitated Nb causes hardening to occur at ordinary temperature.

If the elongation falls or the r-value falls, development of a recrystallized texture is suppressed, so the press-formability and shape freedom at the time of shaping exhaust parts become lower.

Further, Nb is high in material cost. If adding a large amount, the production costs rise.

Further, the Mo which is added to SUS444 is also high in alloy cost. The costs of parts remarkably rise.

If excellent high temperature characteristics could be obtained by additive elements other than Nb and Mo, it would become possible to keep down the amounts of addition of Nb and Mo and provide heat resistant ferritic stainless steel sheets which are low in cost and excellent in workability. Therefore, development of heat resistant ferritic stainless steel sheets kept down in amounts of addition of Nb and Mo is being demanded.

To deal with the rise in exhaust gas temperatures, various materials are being developed for exhaust system members.

PLT's 1 to 4 disclose the art of composite addition of Cu—Mo—Nb—Mn—Si.

PLT 1 discloses to improve the high temperature strength and improve the toughness of stainless steels by the addition of Cu and Mo and to improve the scale spallation resistance by the addition of Mn. PLT 1 shows that addition of 0.6% or more of Mn enables reduction of the amount of scale spallation. However, the scale spallation resistance in the case of exceeding 1000° C.×100 hours is not studied.

PLT 2 shows the art of improving the oxidation resistance of Cu steel by adjusting the additive elements in relation to each other and suppressing the formation of the γ-phase at the steel sheet surface. Results of a continuous oxidation test up to 950° C. are shown.

PLT 3 discloses a method of optimizing the contents of Si and Mn of high Cr steel so as to strikingly improve the repeated oxidation characteristics. However, long term oxidation resistance is not studied.

PLT 4 discloses the art of adjusting the amounts of Mo and W of low Cr steel so as to improve the high temperature strength and oxidation resistance.

The inventors disclosed the art, in PLT 5, of using composite addition of Nb—Mo—Cu—Ti—B so as to cause the fine dispersion of Laves phases and ε-Cu phases and obtain excellent high temperature strength at 850° C. PLT 5 discloses that over 0.6% addition of Mn contributes to improvement of scale adhesion and suppression of abnormal oxidation. The art described in PLT 5 is art for making the oxidation resistance and scale spallation resistance equal to SUS444. Results of oxidation tests at 850° C. and 950° C. are shown.

Further, SUS444 has 2% or so of Mo added, so is high in strength, but cannot handle higher temperatures of over 850° C. Therefore, ferritic stainless steels which have a heat resistance of SUS444 or better are being demanded.

Various materials are being developed for exhaust system members to deal with such demands as well.

PLT 6 studies the method of improvement of thermal fatigue characteristics by control of Cu phases with long axes of 0.5 μm or more to 10/25 $\mu m^2$ or less and Nb compound phases with long axes of 0.5 μm or more to 10/25 $\mu m^2$ or less.

PLT's 7 and 8 disclose methods of defining the amounts of precipitates for obtaining not only solution strengthening by Nb and Mo, but also solution strengthening by Cu and precipitation strengthening by Cu (ϵ-Cu phases) so as to obtain a SUS444 or better high temperature strength.

PLT's 9 and 10 disclose the art of adding W in addition to adding Nb, Mo, and Cu.

PLT 9 discloses the relationship between the Laves phases and ϵ-Cu phases as precipitates and the high temperature strength.

In PLT 10, B is added for further improvement of the workability.

The inventors disclosed, in PLT 11, the art of using the composite addition of Nb—Mo—Cu—Ti—B so as to cause the Laves phases and ϵ-Cu phases to finely disperse and obtain excellent high temperature strength at 850° C.

CITATIONS LIST

Patent Literature

PLT 1: Japanese Patent No. 2696584
PLT 2: Japanese Patent Publication (A) No. 2009-235555
PLT 3: Japanese Patent Publication (A) No. 2010-156039
PLT 4: Japanese Patent Publication (A) No. 2009-1834
PLT 5: Japanese Patent Publication (A) No. 2009-215648
PLT 6: Japanese Patent Publication (A) No. 2008-189974
PLT 7: Japanese Patent Publication (A) No. 2009-120893
PLT 8: Japanese Patent Publication (A) No. 2009-120894
PLT 9: Japanese Patent Publication (A) No. 2009-197307
PLT 10: Japanese Patent Publication (A) No. 2009-197306
PLT 11: Japanese Patent Publication (A) No. 2009-215648

SUMMARY OF INVENTION

Technical Problem

Environments where the exhaust gas temperature exceeds 850° C., in particular, where the maximum temperature becomes over 1000° C., cannot be handled even by the existing type of high heat resistance steel of SUS444. For this reason, ferritic stainless steel which has a SUS444 or better high temperature strength and oxidation resistance is being sought.

Oxidation resistance is evaluated as excellent when both the amount of increase in oxidation and the amount of scale spallation are small in continuous oxidation tests in the air. Automotive exhaust system members are used at high temperatures for long periods of time, so have to exhibit excellent oxidation resistance when held at 1000° C. for 200 hours.

The present invention has as its object the provision of ferritic stainless steel which has a higher oxidation resistance than the past in an environment where the maximum temperature of exhaust gas is 1000° C. or so.

Further, the inventors engaged in intensive studies taking note of the precipitate morphology of Nb carbonitrides in addition to the Laves phases. As a result, they obtained the following new findings.

Laves phases generally precipitate as $Fe_2(Nb,Mo)$ and also cause a reduction of the amounts of solute Nb and Mo.

The inventors discovered that when coarse Nb carbonitrides are present, large numbers of Laves phases precipitate using the Nb carbonitrides as starting points. They learned that this is because coarse Nb carbonitrides not only reduce the solute amounts of Nb and Mo, but also form coarse Laves phases using Nb carbonitrides as starting points and do not contribute to precipitation strengthening.

The present invention was made in consideration of this discovery and has as its object the provision of ferritic stainless steel excellent in heat resistance which has a heat resistance of over 850° C. by control of the precipitate morphology of Nb carbonitrides.

Solution to Problem

The inventors engaged in intensive studies to solve the above problems.

As a result, they discovered that in Cu—Mo—Nb—Mn—Si steel, if the amount of Cr is 16.5 to 20%, by keeping the amount of addition of Mn low and controlling the ingredients to a certain range, the amount of increase in oxidation and amount of scale spallation at the time of long term use at 1000° C. are small and the long term stability of the oxide films is excellent.

FIG. 1 and FIG. 2 show the amount of increase of oxidation and the amount of scale spallation when using 6.6 to 17.0% Cr-0.006 to 0.009% C-0.15 to 0.25% Si-0.10 to 1.13% Mn-2.52 to 2.60% Mo-1.35 to 1.46% Cu-0.45 to 0.48% Nb-0.010 to 0.013% N steel for a continuous oxidation test in the air at 1000° C. for 200 hours.

From FIG. 1 and FIG. 2, it is learned that if the amount of addition of Mn is over 0.60%, the amount of increase of oxidation and the amount of scale spallation rapidly increase.

The reasons why keeping down the amounts of addition of Mn and Si results in better long term stability of the oxide films are not clear. It is guessed that the $(Mn,Cr)_3O_4$ and $SiO_2$ which are formed as oxide films are exposed to high temperatures for a long time, whereby the oxide films become thicker and the difference in thermal stress between the oxide films and matrix phase at the time of cooling becomes larger than the case where the oxide films are thin, so the scale more easily peels off.

In the present invention, further, the means explained below may be used to obtain stainless steel sheet excellent in heat resistance.

In the temperature region of use of exhaust manifolds, that is, the 750 to 950° C. temperature region, precipitates form and grow in large amounts. The inventors engaged in intensive studies with the aim of controlling the Nb-, Mo-based precipitates, that is, the Laves phases, and carbonitrides having Nb as main phases more precisely than in the prior art so as to make maximum use of the effects of solution and precipitation strengthening.

As a result, they discovered that in Nb—Mo—Cu—Ti—B composite steels, fine precipitation of carbonitrides having Nb as main phases is effective for maintaining the solution strengthening abilities of Nb and Mo.

Here, the "carbonitrides having Nb as main phases" mean (Nb,X)(C,N) having Nb as main phases and will be referred to below as "Nb carbonitrides". X includes other metal elements (Ti etc.)

"Having Nb as main phases" means the mass of Nb is over 50% of the total of the masses of Nb and X. Whether Nb exceeds 50% or not specifically can be confirmed by a TEM-equipped EDS apparatus (energy dispersive X-ray spectrometer).

Further, with the composition of ingredients of the present invention, in addition to carbonitrides having Nb as main phases, $Fe_2(Nb,Mo)$ Laves phases precipitate. The Laves phases include Fe and Mo as ingredients, while the carbonitrides having Nb as main phases do not include almost any Fe and Mo. Accordingly, when using an EDS apparatus to quantify the Fe and Mo and they are respectively less than 5 mass %, it can be judged that the substance is not comprised of Laves phases, but carbides having Nb as main phases.

FIG. 3 is a view which shows the particle size of Nb carbonitrides and the ratio of Laves phases precipitated on the Nb carbonitrides in the case of using 16.7% Cr-0.007%

C-0.38% Si-0.70% Mn-1.7% Mo-1.3% Cu-0.64% Nb-0.15% Ti-0.010% N-0.0003% B steel for heat treatment for aging at 950° C. for 5 minutes.

It is learned that if the particle size becomes larger, the ratio of the Laves phases which precipitate on the Nb carbonitrides becomes larger and that if the particle size exceeds 0.2 μm, the ratio rapidly becomes larger.

FIG. 4 is a view which shows the relationship between the average cooling speed from 1050° C. to 750° C. of the final annealing temperature of 19.2% Cr-0.004% C-0.15% Si-0.33% Mn-2.1% Mo-1.2% Cu-0.40% Nb-0.11% Ti-0.012% N-0.0026% B steel and the ratio of Nb carbonitries with a particle size of 0.2 μm or less in the Nb carbonitrides (number ratio).

It is learned that if the cooling speed becomes 7° C./sec or more, carbonitrides with a particle size of 0.2 μm or less become a number ratio of 95% or more.

FIG. 5 is a view which shows the relationship between ratio of 0.2 μm or less Nb carbonitrides of 19.2% Cr-0.004% C-0.15% Si-0.33% Mn-2.1% Mo-1.2% Cu-0.40% Nb-0.11% Ti-0.012% N-0.0026% B steel and the thermal fatigue life at a maximum temperature of 950° C. (constraint ratio: 20%).

It is learned that if Nb carbonitrides with a particle size of 0.2 μm or less are present in a number ratio of 95% or more, the thermal fatigue life is remarkably improved.

The mechanism by which a large number of Lave phases precipitate starting from the Nb carbonitrides or a certain size or more is not clear. It is guessed that if the Nb carbonitrides coarsen, the interfaces become nonaligned and the interfacial energy increases whereupon sites forming nuclei of Lave phases easily form.

Further, the inventors discovered that in Nb—Mo—Cu—Ti—B composite steel, by making the final annealing temperature in the process of production of the stainless steel 1000 to 1200° C. and controlling the cooling speed from the final annealing temperature down to 750° C. to 7° C./sec or more, it is possible to suppress precipitation of over 0.2 μm Nb carbonitrides and coarsening of Nb carbides.

From these results, it was learned that by controlling the cooling speed at the time of the final annealing and making the particle size of the Nb carbonitrides 0.2 μm or less, it is possible to maintain the solution strengthening abilities of Nb and Mo.

Further, the inventors discovered that for precipitation of the Laves phases and ϵ-Cu phases, the effect of fine precipitation due to B can be obtained even at over 850° C.

As explained above, the stainless steel sheet excellent in heat resistance of the present invention was made based on the discovery of actions and effects different from the past in the effects for causing fine precipitation of Nb carbonitrides and enables an improvement of the thermal fatigue life.

The present invention was made based on the above discoveries and has as its gist the following.

Here, elements with no lower limits defined indicate inclusion up to the level of unavoidable impurities.

(1) Ferritic stainless steel sheet excellent in oxidation resistance characterized by containing, by mass %, C: 0.02% or less,
N: 0.02% or less,
Si: over 0.10 to 0.35%,
Mn: 0.10 to 0.60%,
Cr: 16.5 to 20.0%,
Nb: 0.30 to 0.80%,
Mo: over 2.50 to 3.50%, and
Cu: 1.00 to 2.50%,
having a balance of Fe and unavoidable impurities,
having an amount of increase of oxidation after a continuous oxidation test in the air at 1000° C. for 200 hours of 4.0 mg/cm$^2$ or less, and
having an amount of scale spallation of 1.0 mg/cm$^2$ or less.

(2) Ferritic stainless steel sheet excellent in oxidation resistance as set forth in (1) characterized by further containing, by mass %, at least one of W: 2.0% or less and Ti: 0.20% or less.

(3) Ferritic stainless steel sheet excellent in oxidation resistance as set forth in (1) or (2) characterized by containing, by mass %, at least one of B: 0.0030% or less and Mg: 0.0100% or less.

(4) Ferritic stainless steel sheet excellent in oxidation resistance as set forth in any one of (1) to (3) characterized by containing, by mass %, at least one of Al: 1.0% or less, Ni: 1.0% or less, Sn: 1.00% or less, and V: 0.50% or less.

(5) Ferritic stainless steel sheet excellent in oxidation resistance as set forth in any one of (1) to (4) characterized by containing, by mass %, at least one of Zr: 1.0% or less, Hf: 1.0% or less, and Ta: 3.0% or less.

(6) Ferritic stainless steel sheet excellent in heat resistance characterized by containing, by mass %, C: 0.015% or less,
N: 0.020% or less,
Si: over 0.10 to 0.40%,
Mn: 0.10 to 1.00%,
Cr: 16.5 to 25.0%,
Nb: 0.30 to 0.80%,
Mo: 1.00 to 4.00%,
Ti: 0.05 to 0.50%,
B: 0.0003 to 0.0030%, and
Cu: 1.0 to 2.5%,
having a balance of Fe and unavoidable impurities, and
having a structure comprised of carbonitrides which contain Nb and other metal elements present in the steel, wherein among the carbonitrides with a mass of Nb over 50% of the total of masses of the Nb and other metal elements, carbonitrides with a particle size of 0.2 μm or less are in a number ratio of 95% or more.

(7) Ferritic stainless steel sheet excellent in heat resistance as set forth in (6) characterized by further containing, by mass %, W: 3.00% or less.

(8) Ferritic stainless steel sheet excellent in heat resistance as set forth in (6) or (7) characterized by further containing, by mass %, at least one of Al: 3.00% or less,
Sn: 1.00% or less, and
V: 0.10 to 1.00%.

(9) Ferritic stainless steel sheet excellent in heat resistance as set forth in any one of (6) to (8) characterized by further containing, by mass %, at least one of Zr: 1.00% or less,
Hf: 1.00% or less,
Ta: 3.00% or less, and
Mg: 0.0100% or less.

(10) A method of production of ferritic stainless steel sheet excellent in heat resistance as set forth in any one of (6) to (9), said method of production of ferritic stainless steel sheet excellent in heat resistance characterized by
hot rolling a slab which has a composition of ingredients of any of (6) to (9), next,
cold rolling, after that,
final annealing at 1000 to 1200° C., then,
cooling from the temperature of the final annealing down to 750° C. by a cooling speed of 7° C./sec or more.

Advantageous Effects of Invention

According to the present invention, it is possible to provide ferritic stainless steel which has high temperature characteristics of SUS444 or better and has an oxidation resistance at 1000° C. of equal to or better than SUS444. In particular, by applying this to the exhaust system members of automobiles etc., it becomes possible to handle increases in temperature up to near 1000° C.

Further, according to the present invention, it is possible to provide ferritic stainless steel which has high temperature characteristics of SUS444 or better and has thermal fatigue characteristics at 950° C. of equal to or better than SUS444. In particular, by applying this to the exhaust system members of automobiles etc., it becomes possible to handle exhaust gas temperatures even if becoming a high temperature of 950° C. or so.

DESCRIPTION OF EMBODIMENTS

Figure 1:
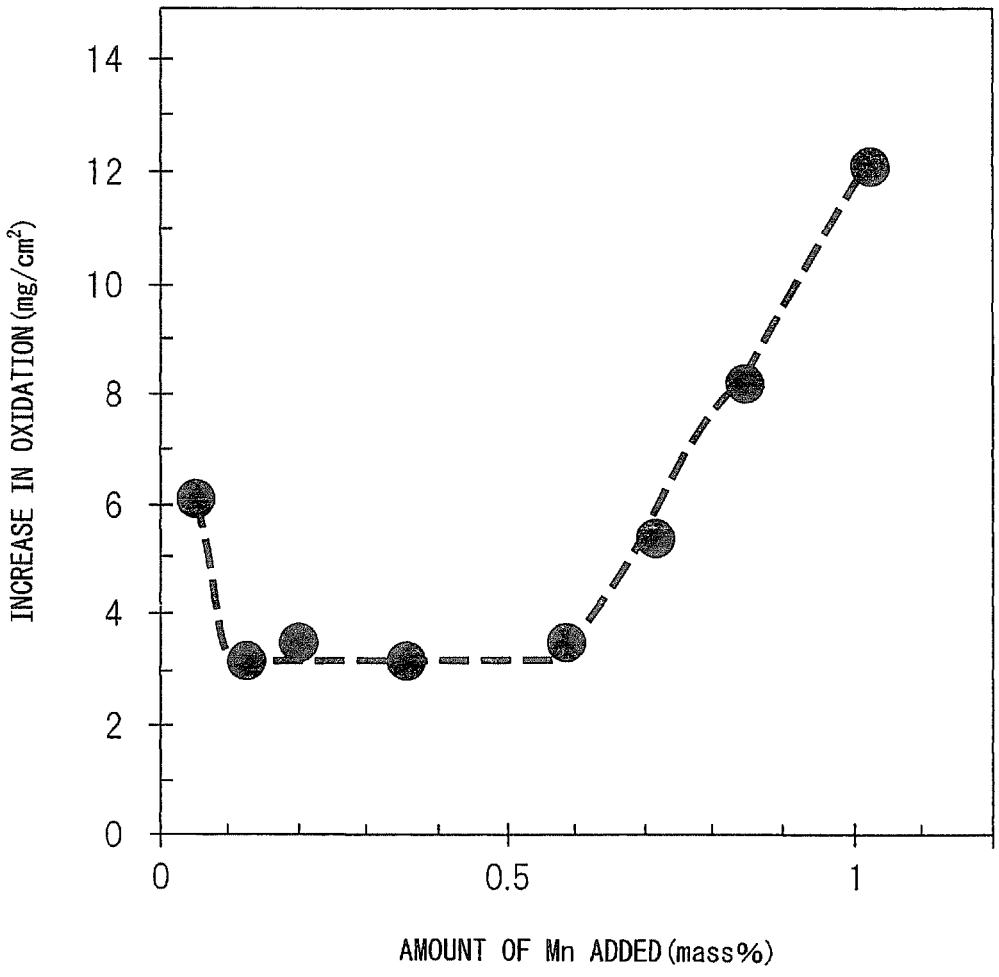
FIG. 1 is a graph which shows the relationship between the amount of added Mn and the amount of increase of oxidation in 16.6 to 17.0% Cr-0.006 to 0.009% C-0.15 to 0.25% Si-0.10 to 1.13% Mn-2.52 to 2.60% Mo-1.35 to 1.46% Cu-0.45 to 0.48% Nb-0.010 to 0.013% N steel.
Figure 2:
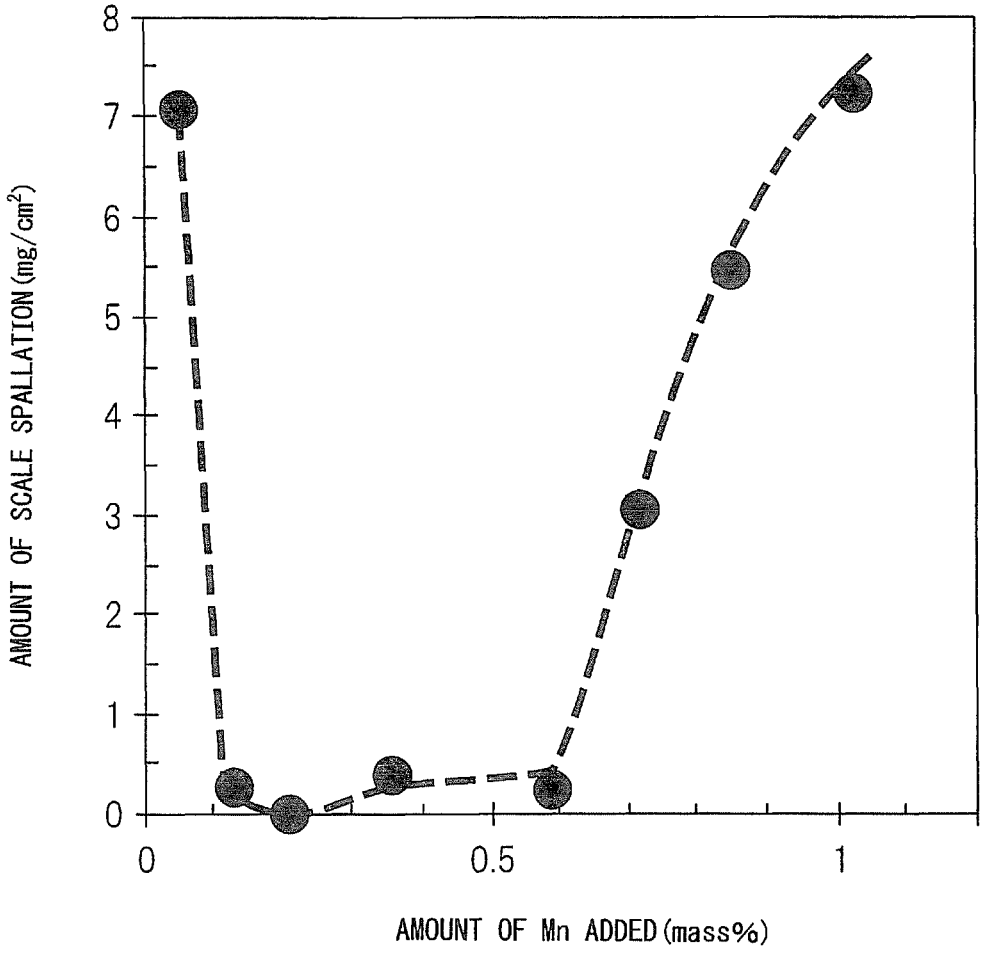
FIG. 2 is a graph which shows the relationship between the amount of added Mn and the amount of increase of scale spallation in 16.6 to 17.0% Cr-0.006 to 0.009% C-0.15 to 0.25% Si-0.10 to 1.13% Mn-2.52 to 2.60% Mo-1.35 to 1.46% Cu-0.45 to 0.48% Nb-0.010 to 0.013% N steel.
Figure 3:
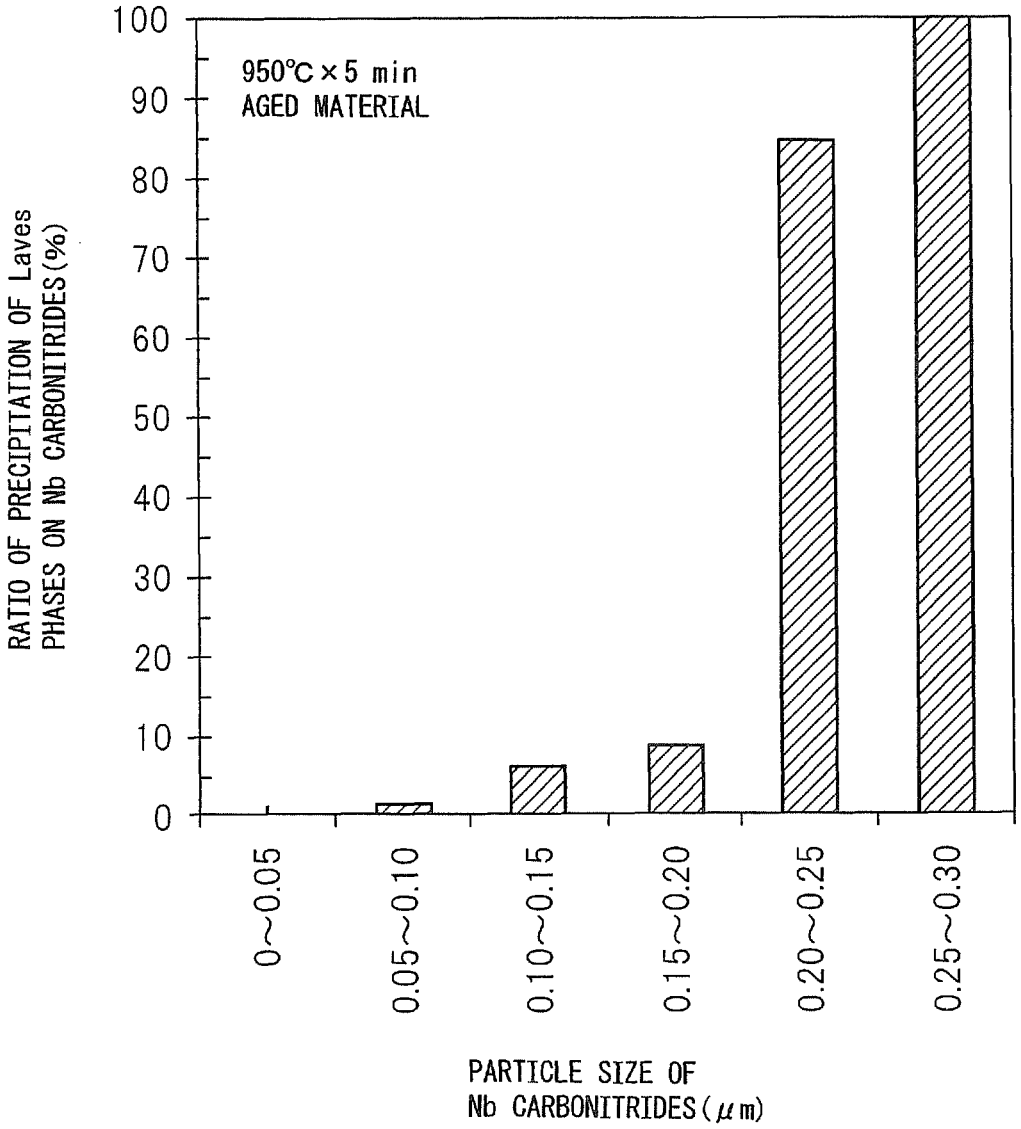
FIG. 3 is a view which shows the relationship between the particle size of Nb carbonitrides and the ratio of Laves phases precipitated on Nb carbonitrides in a material aged by 950° C.×5 min in 16.7% Cr-0.007% C-0.38% Si-0.70% Mn-1.7% Mo-1.3% Cu-0.64% Nb-0.15% Ti-0.010% N-0.0003% B steel.
Figure 4:
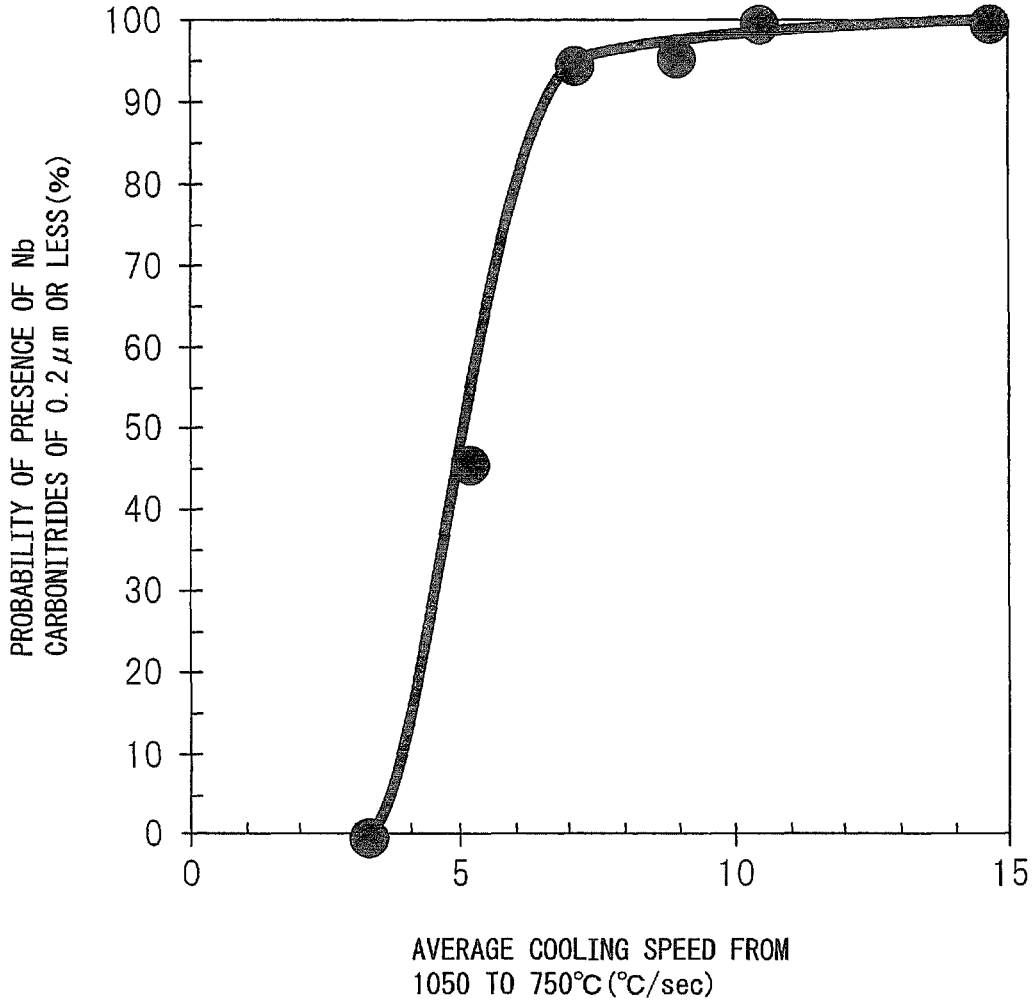
FIG. 4 is a view which shows the relationship between the average cooling speed from 1050 to 750° C. and the ratio of presence of 0.2 μm or less Nb carbonitrides in 19.2% Cr-0.004% C-0.15% Si-0.33% Mn-2.1% Mo-1.2% Cu-0.40% Nb-0.11% Ti-0.012% N-0.0026% B steel.
Figure 5:
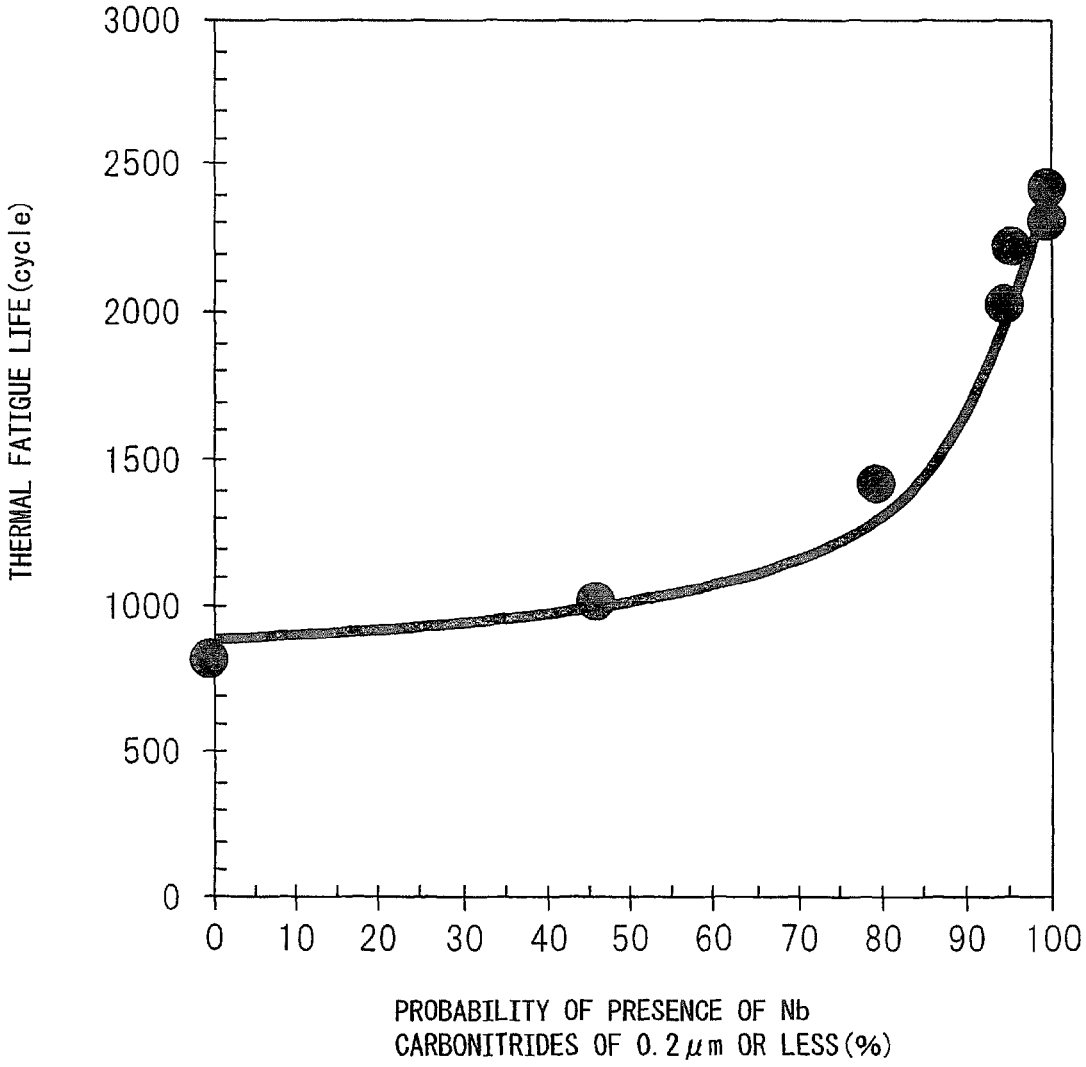
FIG. 5 is a view which shows the relationship between the ratio of presence of 0.2 μm or less Nb carbonitrides and the thermal fatigue life at a maximum temperature of 950° C. (constraint ratio 20%) in 19.2% Cr-0.004% C-0.15% Si-0.33% Mn-2.1% Mo-1.2% Cu-0.40% Nb-0.11% Ti-0.012% N-0.0026% B steel.

Below, the present invention will be explained in detail.

First, the reasons for limitation of the composition of ingredients of the present invention will be explained. Below, "%" shall mean "mass %".

C degrades the shapeability and corrosion resistance and promotes the precipitation of Nb carbonitrides to lower the high temperature strength. The smaller the content of C the better, so is made 0.02% or less. Excessive reduction leads to an increase in the refining costs, so the preferable content of C is 0.003 to 0.015%.

N, like C, degrades the shapeability and corrosion resistance and promotes the precipitation of Nb carbonitrides to lower the high temperature strength. The smaller the content of N the better, so is made 0.02% or less. Excessive reduction leads to an increase in the refining costs, so the preferable content of N is 0.005 to 0.02%.

Si is an element which is extremely important for improving the oxidation resistance. Further, it is also useful as a deoxidizing agent. If the content of Si becomes 0.10% or less, abnormal oxidation more easily occurs. If the content of Si exceeds 0.35%, scale spallation more easily occurs. Accordingly, the content of Si is made over 0.10 to 0.35%.

Si promotes the precipitation of intermetallic compounds mainly comprised of Fe and Nb and Mo, called Laves phases, at a high temperature, lowers the amounts of solute Nb and Mo, and lowers the high temperature strength, so the content of Si is more preferably smaller. The preferable content of Si is over 0.10 to 0.25%.

Mn is an element which is extremely important for forming $(Mn,Cr)_3O_4$, with the ability to protect the stainless steel matrix phase during long term use, on the surface layer part, improving the scale adhesion, and suppressing abnormal oxidation. This effect is obtained by making the content of Mn 0.10% or more. If the Mn content is less than 0.10%, $Fe_3O_4$, with no ability to protect the stainless steel matrix phase during long term use, is formed on the surface layer part and abnormal oxidation more easily occurs. On the other hand, if the Mn content exceeds 0.60%, the oxide film layer of $(Mn,Cr)_3O_4$ becomes thicker and scale spallation more easily occurs, so the upper limit was made 0.60%.

Mn forms MnS to lower the corrosion resistance or lower the uniform elongation at ordinary temperature. Considering this, the Mn content is preferably 0.10 to 0.40%.

Cr is an element which is essential for securing oxidation resistance. If the content of Cr is 16.5% or more, there is a sufficient oxidation resistance at 1000° C. If the content of Cr exceeds 20.0%, the workability falls or the toughness falls. Accordingly, the Cr content is made 16.5 to 20.0%. If considering the high temperature ductility and the production costs, 16.8 to 19.0% is preferable.

Nb is an element which is essential for improvement of the high temperature strength by solution strengthening and precipitation strengthening by fine precipitation of Laves phases. Further, it acts to fix C and N as carbonitrides to improve the corrosion resistance of the finished sheet or grow the recrystallized texture affecting the r-value.

In the Nb—Mo—Cu steel of the present invention, if the content of Nb is 0.30% or more, the effect of the increase of solute Nb and precipitation strengthening is obtained. If the content of Nb exceeds 0.80%, coarsening of the Laves phases is promoted and the high temperature strength falls and costs increase. Accordingly, the Nb content is made 0.30 to 0.80%. If considering the production ability and costs, 0.40 to 0.70% is preferable.

Mo is effective for improving the corrosion resistance and, furthermore, suppressing high temperature oxidation and improving high temperature strength by precipitation strengthening by fine precipitation of Laves phases and by solution strengthening. If the content of Mo exceeds 3.50%, coarsening and precipitation of the Laves phases are promoted, the precipitation strengthening ability falls, and, further, the workability deteriorates.

In Nb—Mo—Cu steel, if the content of Mo exceeds 2.50%, the effect of suppression of the 1000° C. high temperature oxidation and increase of solute Mo and precipitation strengthening is obtained. Accordingly, the Mo content is made over 2.50% to 3.50%. If considering the production ability and costs, 2.60 to 3.20% is preferable.

Cu is an element which is effective for improvement of the high temperature strength. This is the action of precipitation hardening due to precipitation of ε-Cu. To obtain this effect, the content of Cu has to be made 1.00% or more. If the content of Cu exceeds 2.50%, the uniform elongation falls and the ordinary temperature yield strength rises too much, so the press formability becomes obstructed. Furthermore, an austenite phase is formed at the high temperature region and abnormal oxidation occurs at the surface. Accordingly, the Cu content is made 1.00 to 2.50%. If considering the production ability or the scale adhesion, 1.20 to 1.80% is preferable.

In ferritic stainless steel sheet, if the amount of increase of oxidation in a 1000° C.×200 hour continuous oxidation test in the air exceeds 4.0 mg/cm$^2$, the oxide film becomes too thick and scale spallation is promoted. If the amount of scale spallation exceeds 1.0 mg/cm$^2$, if used for a material for the exhaust system of an automobile, the reduction in thickness becomes remarkable. Therefore, the amount of increase of oxidation and the amount of scale spallation in a 1000° C.×200 hour continuous oxidation test in the air respectively have to be made 4.0 mg/cm$^2$ or less and 1.0 mg/cm$^2$ or less.

To further improve the high temperature strength and other various properties, it is possible to add the following elements in accordance with need.

W is an element which has an effect similar to Mo and improves the high temperature strength. If the content of W exceeds 2.0%, it dissolves in the Laves phases to coarsen the precipitates and, further, degrades the production ability and workability. Accordingly, the content of W is made 2.0% or less. If considering the costs and the oxidation resistance etc., 0.10 to 1.50% is preferable.

Ti, by addition in a suitable amount in Nb—Mo steel, contributes to the increase in the solute amount of Nb and Mo at the time of cold rolled annealed sheet, improvement of the high temperature strength, and improvement of the high temperature ductility. If the content of Ti exceeds 0.20%, the amount of solute Ti increases and the uniform elongation falls and, furthermore, coarse Ti-based precipitates form and become starting points of cracking at the time of working and the workability deteriorates. Accordingly, the content of Ti is made 0.20% or less. If considering the occurrence of surface defects and the toughness, 0.05 to 0.15% is preferable.

B is an element which improves the secondary workability at the time of press-forming a product. If the content of B exceeds 0.0030%, hardening occurs and the grain boundary corrosion resistance deteriorates. Accordingly, the content of B is made 0.0030% or less. If considering the shapeability and the production costs, 0.0003 to 0.0020% is preferable.

Mg is an element which improves the secondary workability. If the content of Mg exceeds 0.0100%, the workability remarkably deteriorates. Accordingly, the content of Mg is made 0.0100% or less. If considering the costs and the surface quality, 0.0002 to 0.0010% is preferable.

Al is added as a deoxidizing element and, furthermore, improves the oxidation resistance. Further, it is useful for improving the strength as a solution strengthening element. To stably obtain this effect, the content of Al is preferably made 0.10%. If the content of Al exceeds 1.0%, hardening occurs, the uniform elongation remarkably falls, and, furthermore, the toughness remarkably falls. Accordingly, the content of Al is made 1.0% or less. If considering the occurrence of surface defects, weldability, and production ability, 0.10 to 0.30% is preferable.

If adding Al for the purpose of deoxidation, less than 0.10% of Al remains as unavoidable impurities in the steel.

Ni is an element which improves the corrosion resistance. To stably obtain this effect, the content of Ni is preferably made 0.1% or more. If the content of Ni exceeds 1.0%, an austenite phase is formed in the high temperature region and abnormal oxidation and scale spallation occur at the surface. Accordingly, the content of Ni is made 1.0% or less. If considering the production costs, 0.1 to 0.6% is preferable.

Sn has a large atomic radius, so improves the high temperature strength by solution strengthening. Further, even if added, it does not cause a great deterioration in the mechanical properties at ordinary temperature. If the content of Sn exceeds 1.00%, the production ability and workability remarkably deteriorate. Accordingly, the content of Sn is made 1.00% or less. If considering the oxidation resistance etc., 0.05 to 0.30% is preferable.

V forms fine carbonitrides together with Nb and improves the high temperature strength by precipitation strengthening. If the content of V exceeds 0.50%, the Nb and V carbonitrides coarsen, the high temperature strength falls, and the workability falls. Accordingly, the content of V is made 0.50% or less. If considering the production costs and the production ability, 0.05 to 0.20% is preferable.

Zr is an element which improves the oxidation resistance. If the content of Zr exceeds 1.0%, coarse Laves phases precipitate and the production ability and workability remarkably deteriorate. Accordingly, the content of Zr is made 1.0% or less. If considering the costs and the surface quality, 0.05 to 0.50% is preferable.

Hf, like Zr, is an element which improves the oxidation resistance. If the content of Hf exceeds 1.0%, coarse Laves phases precipitate and the production ability and workability are remarkably degraded. Accordingly, the content of Hf is made 1.0% or less. If considering the costs and the surface quality, 0.05 to 0.50% is preferable.

Ta, like Zr and Hf, is an element which improves the oxidation resistance. If the content of Ta exceeds 3.0%, coarse Laves phases precipitate and the production ability and workability are remarkably degraded. Accordingly, the content of Ta is made 3.0% or less. If considering the costs and the surface quality, 0.05 to 1.00% is preferable.

Next, the method of production of the ferritic stainless steel sheet of the present invention will be explained.

The ferritic stainless steel sheet of the present invention can be produced by the method of production of general ferritic stainless steel.

That is, ferritic stainless steel which has the composition of ingredients of the present invention is smelted to produce a slab which is then heated to 1000 to 1200° C. and hot rolled at 1100 to 700° C. in range to produce 4 to 6 mm hot rolled sheet.

After this, the sheet is annealed at 800 to 1100° C., then pickled. This annealed and pickled sheet is cold rolled to fabricate 1.0 to 2.5 mm cold rolled sheet, then final annealed at 900 to 1100° C. and pickled.

According to this process of production, it is possible to produce the ferritic stainless steel sheet of the present invention.

However, if the cooling speed after the final annealing is slow in speed, Laves phases and other precipitates precipitate in large amounts, so the high temperature strength may fall and the ordinary temperature ductility and other aspects of workability may deteriorate. For this reason, the average cooling speed from the final annealing temperature to 600° C. is preferably controlled to 5° C./sec or more.

Further, the hot rolling conditions of the hot rolled sheet, hot rolled sheet thickness, possible annealing of the hot rolled sheet, cold rolling conditions, annealing temperature of the hot rolled sheet and cold rolled sheet, atmosphere, etc. may be suitably selected. Further, it is also possible to repeat the cold rolling and annealing a plurality of times, perform temper rolling after the cold rolling and annealing, or correct the shape of the steel sheet by a tension leveler. The finished sheet thickness may also be selected in accordance with the thickness of the member demanded.

Next, the ferritic stainless steel sheet excellent in heat resistance of the present invention will be explained.

First, the composition of ingredients will be explained.

C degrades the shapeability and corrosion resistance and promotes the precipitation of Nb carbonitrides to cause a drop in the high temperature strength, so the smaller the content the better. Accordingly, the content of C is made 0.015% or less.

If excessively reducing the content of C, the refining costs increase, so 0.003 to 0.015% is preferable.

N, like C, degrades the shapeability and corrosion resistance and promotes the precipitation of Nb carbonitrides to cause a drop in the high temperature strength, so the smaller the content the better. Accordingly, the content of N is made 0.020% or less. If excessively reducing the content of N, the refining costs increase, so 0.005 to 0.020% is preferable.

Si is an element useful also as a deoxidizing agent and, further, is an extremely important element for improvement of the oxidation resistance. However, Si promotes the precipitation of intermetallic compounds mainly comprised of Fe and Nb and Mo, called Laves phases, at a high temperature, so if the content becomes greater, the high temperature strength falls. Further, if the amount of addition of Si is 0.10% or less, abnormal oxidation tends to easily occur and the oxidation resistance falls. Furthermore, if the content of Si exceeds 0.40%, scale spallation easily occurs.

From these viewpoints, the content of Si is made over 0.10 to 0.40%. However, if envisioning formation of surface defects and other factors causing deterioration of oxidation resistance, there is preferably a safety margin in the oxidation resistance. Over 0.10 to 0.30% is preferable.

Mn is an element which is added as a deoxidizing agent. Further, it forms Mn-based oxides at the surface layer part during long term use and contributes to scale adhesion and suppression of abnormal oxidation. To obtain this effect, the content of Mn has to be made 0.10% or more. If the content of Mn is over 1.00%, the uniform elongation at ordinary temperature falls and, further, MnS is formed thereby causing a drop in the corrosion resistance and the oxidation resistance.

Accordingly, the content of Mn is made 0.10 to 1.00%. If considering the high temperature ductility and scale adhesion, 0.10 to 0.70% is preferable.

Cr is an element which is essential for securing oxidation resistance. If the content of Cr is less than 16.5%, that effect cannot be obtained, while if over 25.0%, the workability falls and the toughness deteriorates. Accordingly, the content of C is made 16.5 to 25.0%. If considering the high temperature ductility and the production costs, 17.0 to 19.0% is preferable.

Nb is an element which is required for improvement of the high temperature strength by solution strengthening and precipitation strengthening by fine precipitation of Laves phases. This effect is remarkably obtained by the Nb carbonitrides becoming finer. Further, this also acts to fix the C and N as carbonitrides and contribute to the corrosion resistance of the finished sheet and the development of a recrystallized texture affecting the r-value.

In the Nb—Mo—Ti—B steel of present invention, if making the content of Nb 0.30% or more, an effect is obtained of increase of solute Nb and precipitation strengthening due to the addition of B. If the content of Nb exceeds 0.80%, coarsening of the Laves phases is promoted, high temperature strength and thermal fatigue life are not contributed to, and the cost increases. Accordingly, the content of Nb is made 0.30 to 0.80%. If considering the production ability and cost, 0.40 to 0.70% is preferable.

Mo is effective for improving the corrosion resistance, further, suppressing high temperature oxidation, and, further, improving the high temperature strength by the precipitation strengthening by fine precipitation of Laves phases and by solution strengthening. To obtain these effects, the content of Mo has to be made 1.00% or more.

If the content of Mo exceeds 4.00%, the Laves phases coarsen and the precipitation strengthening ability falls and, further, the workability deteriorates. That is, high temperature strength and thermal fatigue life are not contributed to and the cost increases. Accordingly, the content of Mo is made 1.00 to 4.00%. If considering the production ability and costs, 1.50 to 3.00% is preferable.

Ti is an important element which, by suitable addition in Nb—Mo—Ti—B steel, causes an increase in the solute amounts of Nb and Mo at the time of cold rolled annealed sheet, improves the high temperature strength, and improves the high temperature ductility and further improves the thermal fatigue characteristics. To obtain these effects, the content of Ti has to be made 0.05% or more. If the content of Ti exceeds 0.50%, the amount of solute Ti increases and the uniform elongation falls, further, coarse Ti-based precipitates are formed and become starting points of cracks at the time of working and the time of thermal fatigue tests, and the workability and thermal fatigue characteristics are degraded. Accordingly, the content of Ti is made 0.05 to 0.50%. If considering the formation of surface defects and toughness, 0.08 to 0.15% is preferable.

B is an important element which, by addition of Nb—Mo—Ti—B, causes a reduction in the amounts of Nb-, Mo-based precipitates and contributes to stability of the high temperature strength and thermal fatigue life. Furthermore, it is an element which improves the secondary workability at the time of press-forming a product. To obtain these effects, the content of B has to be made 0.0003% or more. If the content of B exceeds 0.0030%, hardening, deterioration of the grain boundary corrosion resistance, and weld cracks occur and, further, the thermal fatigue characteristics deteriorate. Accordingly, the content of B is made 0.0003 to 0.0030%. If considering the shapeability and production costs, 0.0003 to 0.0020% is preferable.

Cu is an element which is effective for improvement of the high temperature strength. This is a precipitation strengthening action based on precipitation of ε-Cu. If making the content of Cu 1.0% or more, this action is remarkably manifested. If the content of Cu increases, the uniform elongation drops and the ordinary temperature yield strength becomes too high, so the press shapeability deteriorates. Further, if the content of Cu exceeds 2.5%, an austenite phase is formed at the high temperature region, abnormal oxidation occurs at the surface, and the thermal fatigue characteristics deteriorate. Accordingly, the content of Cu is made 1.0 to 2.5%. If considering the production ability and scale adhesion, 1.2 to 2.0% is preferable.

If the Nb carbonitrides exceed a particle size of 0.2 μm, large numbers of Laves phases precipitate at the Nb carbonitride interfaces and cause a drop in the amount of solution strengthening by Nb and Mo and a drop in the amount of precipitation strengthening by the Laves phases. Accordingly, the Nb carbonitrides with a particle size of 0.2 μm or less have to be present in a number ratio of 95% or more.

If the Nb carbonitrides with a particle size of 0.2 μm or less are present in a number ratio of 95% or more, the Laves phases in the particles will mainly precipitate from locations other than the Nb carbonitrides and contribute to precipitation strengthening. The particle size of the Nb carbonitrides is made the circle equivalent diameter obtained by using a TEM-equipped EDS apparatus (energy dispersive X-ray spectrometer) to quantify the Fe, Nb, Mo, and Ti, judging the particles to be Nb carbonitrides when the Fe and Mo which are contained in the carbonitrides are respectively less than mass %, using image analysis to find the areas of 300 Nb carbonitrides, and calculating from the found areas.

To further improve the high temperature strength and other properties, if necessary, at least one of W, Al, Sn, V, Zr, Hf, Ta, and Mg may be added as optional elements.

W is an element which has an effect similar to Mo and improves the high temperature strength. To stably obtain this effect, the content of W is preferably made 0.10% or more. If the content of W exceeds 3.00%, the W dissolves in the Laves phases and causes the precipitates to coarsen, whereby the production ability and workability deteriorate. Accordingly, the content of W is made 3.00% or less. If considering the costs and the oxidation resistance etc., 1.00 to 1.80% is preferable.

Al is an element which is added as a deoxidizing element and, further, improves the oxidation resistance. Furthermore, it is useful as a solution strengthening element for improving the strength. To stably obtain these effects, the content of Al is preferably made 0.10% or more. If the content of Al exceeds 3.00%, hardening occurs, the uniform elongation is remarkably lowered, and, furthermore, the toughness remarkably falls. Accordingly, the content of Al is made 3.00% or less. If considering the occurrence of surface defects and the weldability and production ability, 0.10 to 2.00% is preferable.

Note that when adding Al for the purpose of deoxidation, less than 0.10% of Al remains in the steel as unavoidable impurities.

Sn is an element with a large atomic radius and effective for solution strengthening. It does not greatly degrade the ordinary temperature mechanical properties. To contribute to high temperature strength, the content of Sn is preferably made 0.05% or more. If the content of Sn exceeds 1.00%, the production ability and workability remarkably deteriorate. Accordingly, the content of Sn is made 1.00% or less. If considering the oxidation resistance etc., 0.05 to 0.50% is preferable.

V combines with Nb to form fine carbonitrides whereby a precipitation strengthening action occurs and improvement of the high temperature strength is contributed to. To obtain this effect, the content of V has to be made 0.10% or more. If the content of V exceeds 1.00%, the Nb carbonitrides (Nb,V)(C,N) coarsen, the high temperature strength falls, and the thermal fatigue life and workability fall. Accordingly, the content of V is made 0.10 to 1.00%. If considering the production costs and the production ability, 0.10 to 0.50% is preferable.

Zr is an element which improves the oxidation resistance. To obtain this effect, the content of Zr is preferably made 0.05% or more. If the content of Zr exceeds 1.00%, coarse Laves phases precipitate and the production ability and workability remarkably deteriorate. Accordingly, the content of Zr is made 1.00% or less. If considering the costs and surface quality, 0.05 to 0.50% is preferable.

Hf, like Zr, is an element which improves the oxidation resistance. To obtain this effect, the content of Hf is preferably made 0.05% or more. If the content of Hf exceeds 1.00%, coarse Laves phases precipitate and the production ability and workability remarkably deteriorate. Accordingly, the content of Hf is made 1.00% or less. If considering the costs and surface quality, 0.05 to 0.50% is preferable.

Ta, like Zr and Hf, is an element which improves the oxidation resistance. To obtain this effect, the content of Ta is preferably made 0.05% or more. If the content of Ta exceeds 3.00%, coarse Laves phases precipitate and the production ability and workability remarkably deteriorate. Accordingly, the content of Ta is made 3.00% or less. If considering the costs and surface quality, 0.05 to 1.00% is preferable.

Mg is an element which improves the secondary workability. To obtain this effect, the content of Mg is preferably made 0.0003% or more. If the content of Mg exceeds 0.0100%, the workability remarkably deteriorates. Accordingly, the content of Mn is made 0.0100% or less. If considering the cost and surface quality, 0.0003 to 0.0020% is preferable.

Next, the method of production of the ferritic stainless steel sheet excellent in heat resistance of the present invention will be explained.

The ferritic stainless steel sheet excellent in heat resistance of the present invention can be produced by the ordinary method of production of melting to produce a slab of steel which has a predetermined composition of ingredients, then hot rolling it to prepare a hot rolled sheet, after that, pickling it, next cold rolling and annealing it.

Here, to obtain a structure in which the Nb carbonitrides with a particle size of 0.2 μm or less are present in a number ratio with respect to the entire Nb carbonitrides of 95% or more, it is necessary to make the final annealing temperature 1000 to 1200° C., heat by soaking for 0 to 20 minutes, then control the average cooling speed from the final annealing temperature down to 750° C. to 7° C./sec or more.

The particle size of the Nb carbonitrides is made the circle equivalent diameter obtained by finding the areas of carbonitries in 300 particles from a TEM micrograph by image analysis and calculating from the areas.

If controlling the average cooling speed from the final annealing temperature down to 750° C. to 7° C./sec or more, the Nb carbonitrides with a particle size of 0.2 μm or less become present in a number ratio with respect to the entire Nb carbonitrides of 95% or more. As a result, the solution strengthening ability of Nb and Mo is maintained. Further, even if Laves phases precipitate, precipitation strengthening by fine precipitation of Laves phases acts, so the thermal fatigue life is improved.

The greater the cooling speed, the smaller the particle size of the Nb carbonitrides, but if considering the surface quality, shape of the steel sheet, and production costs, the cooling speed is preferably 7 to 25° C./sec.

Further, the higher the final annealing temperature, the more the dissolution of Nb carbonitrides is promoted, so it is possible to reduce the amount of precipitation of Nb carbonitrides in the cold rolled and annealed sheet and reduce the particle size. However, if the annealing temperature exceeds 1200° C., the crystal grains coarsen and cause deterioration of toughness, so the upper limit of the final annealing temperature is made 1200° C. If considering the surface quality, shape of the steel sheet, and production costs, the final annealing temperature is preferably made 1000 to 1150° C.

The method of production of the steel sheet is not particularly prescribed other than making the final annealing temperature of the cold rolled sheet 1000 to 1200° C. and making the cooling speed from the final annealing temperature to 750° C. 7° C./sec or more. The hot rolling conditions, hot rolled sheet thickness, possible annealing of the hot rolled sheet, cold rolling conditions, hot rolled sheet and annealing temperature, atmosphere, etc. may be suitably selected. Further, it is also possible to repeat the cold rolling and annealing a plurality of times, perform temper rolling after the cold rolling and annealing, or correct the shape of the steel sheet by a tension leveler. The finished sheet thickness may also be selected in accordance with the thickness of the member demanded.

Example 1

Method of Sample Preparation

Steels of the compositions of ingredients which are shown in Table 1 and Table 2 were smelted and cast into 50 kg slabs. The slabs were hot rolled at 1100 to 700° C. to obtain 5 mm thick hot rolled sheets. After that, the hot rolled sheets were annealed at 900 to 1000° C., then pickled and were cold rolled down to 2 mm thickness, annealed, and pickled to obtain the finished sheets. The underlines in Table 2 show values outside the scope prescribed by the present invention.

TABLE 1

| | No. | Content of ingredients (mass %) | | | | | | | | | | |
|---|---|---|---|---|---|---|---|---|---|---|---|---|
| | | C | N | Si | Mn | Cr | Nb | Mo | Cu | W | Ti | B |
| Inv. ex. | 1 | 0.006 | 0.012 | 0.13 | 0.15 | 16.8 | 0.50 | 2.73 | 1.41 | — | — | — |
| | 2 | 0.005 | 0.010 | 0.11 | 0.22 | 17.7 | 0.45 | 3.01 | 1.52 | — | — | — |
| | 3 | 0.005 | 0.012 | 0.15 | 0.12 | 18.0 | 0.31 | 3.46 | 1.45 | — | — | — |
| | 4 | 0.007 | 0.009 | 0.33 | 0.60 | 17.1 | 0.55 | 2.80 | 1.60 | — | — | — |
| | 5 | 0.006 | 0.010 | 0.24 | 0.39 | 20.0 | 0.48 | 2.82 | 1.38 | — | — | — |
| | 6 | 0.005 | 0.010 | 0.16 | 0.10 | 18.6 | 0.78 | 2.54 | 1.49 | — | — | — |
| | 7 | 0.005 | 0.013 | 0.11 | 0.13 | 17.3 | 0.71 | 2.73 | 1.23 | — | — | — |
| | 8 | 0.003 | 0.019 | 0.12 | 0.18 | 17.5 | 0.48 | 3.18 | 1.50 | — | — | — |
| | 9 | 0.010 | 0.011 | 0.11 | 0.46 | 16.9 | 0.41 | 2.62 | 1.75 | — | — | — |
| | 10 | 0.005 | 0.011 | 0.15 | 0.23 | 18.0 | 0.45 | 2.74 | 2.47 | 0.50 | — | — |
| | 11 | 0.005 | 0.011 | 0.14 | 0.25 | 18.8 | 0.44 | 2.97 | 1.52 | 0.81 | 0.16 | — |
| | 12 | 0.005 | 0.012 | 0.13 | 0.12 | 16.5 | 0.52 | 2.90 | 1.52 | — | 0.10 | — |
| | 13 | 0.008 | 0.009 | 0.24 | 0.41 | 17.0 | 0.56 | 2.52 | 1.43 | 0.94 | — | 0.0005 |
| | 14 | 0.005 | 0.011 | 0.16 | 0.30 | 17.4 | 0.52 | 2.87 | 1.45 | — | 0.13 | 0.0008 |
| | 15 | 0.006 | 0.010 | 0.13 | 0.15 | 17.9 | 0.44 | 2.53 | 1.51 | 1.43 | 0.15 | 0.0020 |
| | 16 | 0.006 | 0.010 | 0.12 | 0.15 | 18.1 | 0.47 | 2.55 | 1.50 | — | — | — |
| | 17 | 0.006 | 0.011 | 0.16 | 0.12 | 17.5 | 0.56 | 2.74 | 1.54 | — | 0.07 | — |
| | 18 | 0.009 | 0.008 | 0.28 | 0.21 | 18.3 | 0.47 | 2.99 | 1.47 | — | — | — |
| | 19 | 0.008 | 0.013 | 0.27 | 0.13 | 17.5 | 0.50 | 2.77 | 1.60 | — | — | 0.0006 |
| | 20 | 0.005 | 0.011 | 0.16 | 0.57 | 17.4 | 0.43 | 3.10 | 1.52 | — | — | — |
| | 21 | 0.007 | 0.010 | 0.16 | 0.20 | 17.0 | 0.45 | 2.86 | 1.54 | — | — | — |
| | 22 | 0.006 | 0.010 | 0.12 | 0.19 | 18.4 | 0.48 | 2.94 | 1.44 | — | — | — |
| | 23 | 0.005 | 0.012 | 0.11 | 0.12 | 17.7 | 0.53 | 2.80 | 1.50 | — | — | — |

| | No. | Content of ingredients (mass %) | | | | | | | |
|---|---|---|---|---|---|---|---|---|---|
| | | Mg | Al | Ni | Sn | V | Zr | Hf | Ta |
| Inv. ex. | 1 | — | — | — | — | — | — | — | — |
| | 2 | — | — | — | — | — | — | — | — |
| | 3 | — | — | — | — | — | — | — | — |
| | 4 | — | — | — | — | — | — | — | — |
| | 5 | — | — | — | — | — | — | — | — |
| | 6 | — | — | — | — | — | — | — | — |
| | 7 | — | — | — | — | — | — | — | — |
| | 8 | — | — | — | — | — | — | — | — |
| | 9 | — | — | — | — | — | — | — | — |
| | 10 | — | — | — | — | — | — | — | — |
| | 11 | — | — | — | — | — | — | — | — |
| | 12 | — | — | — | — | — | — | — | — |
| | 13 | — | — | — | — | — | — | — | — |
| | 14 | — | — | — | — | — | — | — | — |
| | 15 | — | — | — | — | — | — | — | — |
| | 16 | 0.0006 | — | — | — | — | — | — | — |
| | 17 | — | 0.25 | — | — | — | — | — | — |
| | 18 | — | — | 0.54 | — | — | — | — | — |
| | 19 | — | — | — | 0.15 | — | — | — | — |
| | 20 | — | — | — | — | 0.10 | — | — | — |
| | 21 | — | — | — | — | 0.06 | 0.25 | — | — |
| | 22 | — | — | — | — | — | — | 0.30 | — |
| | 23 | — | — | — | — | — | — | — | 0.58 |

TABLE 2

| | No. | Content of ingredients (mass %) | | | | | | | | | |
|---|---|---|---|---|---|---|---|---|---|---|---|
| | | C | N | Si | Mn | Cr | Nb | Mo | Cu | W | Ti |
| Comp. ex. | 24 | 0.026 | 0.013 | 0.15 | 0.21 | 16.8 | 0.45 | 2.94 | 1.41 | — | — |
| | 25 | 0.006 | 0.030 | 0.14 | 0.22 | 17.5 | 0.50 | 2.71 | 1.35 | — | — |
| | 26 | 0.005 | 0.011 | 0.05 | 0.10 | 17.1 | 0.48 | 2.80 | 1.44 | — | — |
| | 27 | 0.005 | 0.010 | 0.40 | 0.58 | 18.0 | 0.51 | 2.76 | 1.42 | — | — |
| | 28 | 0.005 | 0.010 | 0.22 | 0.03 | 17.4 | 0.45 | 3.12 | 1.60 | — | — |
| | 29 | 0.007 | 0.011 | 0.34 | 0.68 | 17.8 | 0.60 | 2.94 | 1.65 | — | — |
| | 30 | 0.006 | 0.009 | 0.14 | 0.23 | 14.2 | 0.57 | 2.81 | 1.53 | — | — |
| | 31 | 0.006 | 0.012 | 0.12 | 0.15 | 23.4 | 0.44 | 2.87 | 1.55 | — | — |
| | 32 | 0.005 | 0.010 | 0.27 | 0.30 | 17.4 | 0.15 | 3.10 | 1.48 | — | — |
| | 33 | 0.005 | 0.010 | 0.18 | 0.27 | 17.7 | 0.90 | 2.55 | 1.30 | — | — |
| | 34 | 0.007 | 0.010 | 0.15 | 0.15 | 17.3 | 0.55 | 1.85 | 1.42 | — | — |
| | 35 | 0.008 | 0.009 | 0.20 | 0.42 | 17.5 | 0.48 | 4.06 | 1.26 | — | — |
| | 36 | 0.005 | 0.011 | 0.13 | 0.24 | 18.6 | 0.53 | 2.86 | 0.61 | — | — |
| | 37 | 0.005 | 0.010 | 0.27 | 0.32 | 17.1 | 0.57 | 2.54 | 3.07 | — | — |
| | 38 | 0.005 | 0.010 | 0.18 | 0.20 | 18.5 | 0.45 | 2.60 | 1.48 | 2.59 | — |

TABLE 2-continued

| | | | | | | | | | | |
|---|---|---|---|---|---|---|---|---|---|---|
| 39 | 0.006 | 0.010 | 0.15 | 0.45 | 18.8 | 0.59 | 3.23 | 1.37 | — | 0.43 |
| 40 | 0.007 | 0.015 | 0.28 | 0.15 | 18.6 | 0.53 | 2.74 | 1.71 | — | — |
| 41 | 0.006 | 0.012 | 0.13 | 0.50 | 17.4 | 0.55 | 2.86 | 1.58 | — | — |
| 42 | 0.006 | 0.012 | 0.20 | 0.18 | 17.2 | 0.55 | 2.85 | 1.50 | — | — |
| 43 | 0.007 | 0.011 | 0.16 | 0.25 | 17.7 | 0.51 | 2.95 | 1.80 | — | — |
| 44 | 0.006 | 0.012 | 0.30 | 0.32 | 17.5 | 0.55 | 2.92 | 1.48 | — | — |
| 45 | 0.007 | 0.011 | 0.13 | 0.24 | 16.5 | 0.45 | 2.70 | 1.33 | — | — |
| 46 | 0.005 | 0.012 | 0.25 | 0.40 | 17.8 | 0.50 | 2.88 | 1.45 | — | — |
| 47 | 0.006 | 0.010 | 0.12 | 0.20 | 18.0 | 0.54 | 3.20 | 1.56 | — | — |
| 48 | 0.005 | 0.011 | 0.15 | 0.25 | 18.1 | 0.59 | 3.01 | 1.61 | — | — |

| | | Content of ingredients (mass %) | | | | | | | | |
|---|---|---|---|---|---|---|---|---|---|---|
| | No. | B | Mg | Al | Ni | Sn | V | Zr | Hf | Ta |
| Comp. ex. | 24 | — | — | — | — | — | — | — | — | — |
| | 25 | — | — | — | — | — | — | — | — | — |
| | 26 | — | — | — | — | — | — | — | — | — |
| | 27 | — | — | — | — | — | — | — | — | — |
| | 28 | — | — | — | — | — | — | — | — | — |
| | 29 | — | — | — | — | — | — | — | — | — |
| | 30 | — | — | — | — | — | — | — | — | — |
| | 31 | — | — | — | — | — | — | — | — | — |
| | 32 | — | — | — | — | — | — | — | — | — |
| | 33 | — | — | — | — | — | — | — | — | — |
| | 34 | — | — | — | — | — | — | — | — | — |
| | 35 | — | — | — | — | — | — | — | — | — |
| | 36 | — | — | — | — | — | — | — | — | — |
| | 37 | — | — | — | — | — | — | — | — | — |
| | 38 | — | — | — | — | — | — | — | — | — |
| | 39 | — | — | — | — | — | — | — | — | — |
| | 40 | 0.0047 | — | — | — | — | — | — | — | — |
| | 41 | — | 0.0120 | — | — | — | — | — | — | — |
| | 42 | — | — | 2.17 | — | — | — | — | — | — |
| | 43 | — | — | — | 1.87 | — | — | — | — | — |
| | 44 | — | — | — | — | 1.15 | — | — | — | — |
| | 45 | — | — | — | — | — | 0.82 | — | — | — |
| | 46 | — | — | — | — | — | — | 1.38 | — | — |
| | 47 | — | — | — | — | — | — | — | 1.41 | — |
| | 48 | — | — | — | — | — | — | — | — | 3.56 |

The annealing temperature of the cold rolled sheets was made 1000 to 1200° C. Nos. 1 to 23 of Table 1 are invention examples, while Nos. 24 to 48 of Table 2 are comparative examples.

Oxidation Resistance Test

From the obtained stainless steel sheets, oxidation test pieces of 20 mm×20 mm×sheet thickness as is were prepared. Continuous oxidation tests were run in the air at 1000° C. for 200 hours and the presence of abnormal oxidation and scale spallation were evaluated (based on JIS Z 2281).

The amount of increase of oxidation and the amount of scale spallation were evaluated including the recovered peeled off oxide films as well.

If the amount of increase of oxidation was 4.0 mg/cm$^2$ or less, the piece was evaluated as having no abnormal oxidation, that is, was indicated as "A", while otherwise it was evaluated as having abnormal oxidation, that is, was indicated as "C", in Tables 3 and 4. Further, if the amount of scale spallation was 1.0 mg/cm$^2$ or less, the piece was evaluated as having little scale spallation, that is, was indicated as "B", if there was no scale spallation, it was indicated as "A", and otherwise it was evaluated as having large scale spallation, that is, was indicated as "C" in Tables 3 and 4.

High Temperature Tensile Test

High temperature tensile test pieces having the rolling directions as the longitudinal directions and having lengths of 100 mm were prepared from the finished sheets. Tensile tests were run at 1000° C. and the 0.2% yield strengths were measured (based on JIS G 0567).

When the 0.2% yield strength at 1000° C. was 15 MPa or more, the piece was indicated as "A", while when less than 15 MPa, it was indicated as "C" in Tables 3 and 4.

Evaluation of Workability at Ordinary Temperature

JIS 13B test pieces having the directions parallel to the rolling directions as the longitudinal directions were prepared based on JIS Z 2201. These test pieces were used for tensile tests. The elongations at break were measured (based on JIS Z 2241).

If the elongation at break at ordinary temperature is 30% or more, working into general exhaust parts is possible, so the case of having a 30% or more elongation at break was indicated as "A" and the case of less than 30% was indicated as "C" in Tables 3 and 4.

The results of the tests are shown in Table 3 and Table 4.

TABLE 3

| | No. | Abnormal oxidation after 1000° C. 200 hr continuous oxidation test | Amount of scale spallation after 1000° C. 200 hr continuous oxidation test | 1000° C. 0.2% yield strength | Ordinary temp. elongation at break |
|---|---|---|---|---|---|
| Inv. ex. | 1 | A | A | A | A |
| | 2 | A | A | A | A |

TABLE 3-continued

| No. | Abnormal oxidation after 1000° C. 200 hr continuous oxidation test | Amount of scale spallation after 1000° C. 200 hr continuous oxidation test | 1000° C. 0.2% yield strength | Ordinary temp. elongation at break |
|---|---|---|---|---|
| 3 | A | B | A | A |
| 4 | A | B | A | A |
| 5 | A | A | A | A |
| 6 | A | B | A | A |
| 7 | A | B | A | A |
| 8 | A | A | A | A |
| 9 | A | B | A | A |
| 10 | A | A | A | A |
| 11 | A | A | A | A |
| 12 | A | B | A | A |
| 13 | A | B | A | A |
| 14 | A | A | A | A |
| 15 | A | B | A | A |
| 16 | A | B | A | A |
| 17 | A | A | A | A |
| 18 | A | B | A | A |
| 19 | A | B | A | A |
| 20 | A | B | A | A |
| 21 | A | A | A | A |
| 22 | A | A | A | A |
| 23 | A | A | A | A |

TABLE 4

| | No. | Abnormal oxidation after 1000° C. 200 hr continuous oxidation test | Amount of scale spallation after 1000° C. 200 hr continuous oxidation test | 1000° C. 0.2% yield strength | Ordinary temp. elongation at break |
|---|---|---|---|---|---|
| Comp. ex. | 24 | A | A | C | C |
| | 25 | A | A | C | C |
| | 26 | C | B | A | A |
| | 27 | A | C | C | A |
| | 28 | C | C | A | A |
| | 29 | A | C | A | C |
| | 30 | C | C | A | A |
| | 31 | A | A | A | C |
| | 32 | A | B | C | A |
| | 33 | A | B | A | C |
| | 34 | A | B | C | A |
| | 35 | A | B | A | C |
| | 36 | A | B | C | A |
| | 37 | C | B | A | C |
| | 38 | A | B | A | C |
| | 39 | A | B | A | C |
| | 40 | A | B | A | C |
| | 41 | A | B | A | C |
| | 42 | A | A | A | C |
| | 43 | C | C | A | A |
| | 44 | A | B | A | C |
| | 45 | A | B | C | C |
| | 46 | A | A | A | C |
| | 47 | A | A | A | C |
| | 48 | A | A | A | C |

Results of Evaluation

As clear from Table 3 and Table 4, the steels which have the composition of ingredients prescribed by the present invention have smaller amounts of increase of oxidation and amounts of scale spallation at 1000° C. compared with the steels of the comparative examples and are excellent in high temperature yield strength as well.

Further, in mechanical properties at ordinary temperature, they have excellent elongations at break and workabilities equal to or better than steels of the comparative examples.

Invention Example Nos. 1 to 23, which have contents of ingredients within the scope of the present invention, gave excellent properties. Nos. 1, 2, 8, 10, 11, 14, 17, and 21 to 23 which have contents of ingredients in the preferable ranges are particularly excellent in properties and did not exhibit any scale spallation.

No. 5 has a content of Cr higher than the preferable range, but did not exhibit scale spallation.

Nos. 24 and 25 respectively have contents of C and N outside the upper limits prescribed by the present invention. They have lower 1000° C. yield strengths and ordinary temperature ductilities than the invention examples.

No. 26 has a content of Si outside the lower limit prescribed by the present invention. It has a greater amount of increase of oxidation than the invention examples.

No. 27 has a content of Si outside the upper limit prescribed by the present invention. It has a greater amount of scale spallation than the invention examples and an inferior high temperature yield strength as well.

Nos. 28 and 30 respectively have contents of Mn and Cr outside the lower limits prescribed by the present invention. They have greater amounts of increase of oxidation and amounts of scale spallation than the invention examples.

No. 29 has Mn added in excess. It has inferior scale spallation and low ductility at ordinary temperature.

No. 31 has a content of Cr outside the upper limit prescribed by the present invention. It has a small amount of increase of oxidation and amount of scale spallation, but low ordinary temperature ductility.

Nos. 32, 34, and 36 respectively have contents of Nb, Mo, and Cu outside the lower limits prescribed by the present invention. They have low 1000° C. yield strengths.

Nos. 33 and 35 respectively have contents of Nb and Mo outside the upper limits prescribed by the present invention. They have little amounts of increase of oxidation and amounts of scale spallation, but have low ordinary temperature ductilities.

No. 37 has a content of Cu outside the upper limit prescribed by the present invention. It has a large amount of increase of oxidation and an inferior ordinary temperature ductility as well.

Nos. 38 to 42 and 44 to 48 respectively have contents of W, Ti, B, Mg, Al, Sn, V, Zr, Hf, and Ta outside the upper limits prescribed by the present invention. They have little amounts of increase of oxidation and the amounts of scale spallation, but low ordinary temperature ductilities.

No. 43 has Ni outside the upper limit prescribed by the present invention. It has a lower oxidation resistance than the invention examples.

Example 2

Sample Preparation

Steels of the compositions of ingredients which are shown in Tables 5 and 6 were smelted and cast into slabs. The slabs were hot rolled to obtain 5 mm thick hot rolled coils. After that, the hot rolled coils were annealed at 1000 to 1200° C., then were pickled, cold rolled to 2 mm thicknesses, annealed, and pickled to obtain the finished sheets.

The annealing temperature of the cold rolled sheets was made 1000 to 1200° C. Nos. 101 to 121 of Table 5 are invention examples, while Nos. 122 to 150 of Table 6 are comparative examples.

TABLE 5

| | No. | Content of ingredients (mass %) | | | | | | | | | | | | | | | | | |
|---|---|---|---|---|---|---|---|---|---|---|---|---|---|---|---|---|---|---|---|
| | | C | N | Si | Mn | Cr | Nb | Mo | Cu | Ti | B | W | Al | Sn | V | Zr | Hf | Ta | Mg |
| Inv. ex. | 101 | 0.005 | 0.010 | 0.13 | 0.99 | 17.5 | 0.57 | 1.52 | 1.1 | 0.10 | 0.0015 | — | — | — | — | — | — | — | — |
| | 102 | 0.007 | 0.010 | 0.38 | 0.70 | 17.0 | 0.64 | 1.70 | 1.3 | 0.15 | 0.0003 | — | — | — | — | — | — | — | — |
| | 103 | 0.006 | 0.012 | 0.14 | 0.64 | 18.0 | 0.78 | 1.23 | 1.3 | 0.11 | 0.0005 | — | 0.20 | — | — | — | — | — | — |
| | 104 | 0.006 | 0.012 | 0.22 | 0.71 | 19.1 | 0.57 | 1.58 | 2.5 | 0.09 | 0.0011 | — | — | — | — | — | — | — | — |
| | 105 | 0.005 | 0.010 | 0.11 | 0.24 | 17.5 | 0.51 | 3.92 | 1.5 | 0.12 | 0.0008 | — | — | — | — | — | — | — | — |
| | 106 | 0.003 | 0.009 | 0.15 | 0.42 | 18.3 | 0.60 | 1.85 | 1.5 | 0.20 | 0.0028 | — | 2.83 | — | — | — | — | — | — |
| | 107 | 0.007 | 0.010 | 0.30 | 0.37 | 24.7 | 0.31 | 1.33 | 1.3 | 0.17 | 0.0014 | — | — | — | — | — | — | — | — |
| | 108 | 0.005 | 0.011 | 0.15 | 0.13 | 17.4 | 0.50 | 3.01 | 1.5 | 0.06 | 0.0008 | — | — | — | — | — | — | — | — |
| | 109 | 0.004 | 0.009 | 0.22 | 0.50 | 20.1 | 0.48 | 1.69 | 2.4 | 0.14 | 0.0005 | — | 0.15 | — | — | — | — | — | — |
| | 110 | 0.004 | 0.009 | 0.15 | 0.88 | 19.5 | 0.35 | 1.20 | 2.0 | 0.48 | 0.0010 | — | 0.14 | — | — | — | — | — | — |
| | 111 | 0.004 | 0.012 | 0.15 | 0.33 | 19.2 | 0.40 | 2.05 | 1.2 | 0.11 | 0.0026 | — | — | — | — | — | — | — | — |
| | 112 | 0.005 | 0.012 | 0.12 | 0.15 | 17.3 | 0.55 | 1.83 | 1.5 | 0.20 | 0.0004 | 1.24 | — | — | — | — | — | — | — |
| | 113 | 0.006 | 0.010 | 0.20 | 0.25 | 17.0 | 0.53 | 1.99 | 1.5 | 0.11 | 0.0003 | 1.10 | 0.11 | — | — | — | — | — | — |
| | 114 | 0.004 | 0.010 | 0.30 | 0.65 | 16.5 | 0.43 | 2.04 | 1.4 | 0.20 | 0.0018 | 1.76 | — | 0.18 | — | — | — | — | — |
| | 115 | 0.008 | 0.015 | 0.31 | 0.73 | 17.3 | 0.65 | 1.51 | 1.8 | 0.11 | 0.0013 | — | — | 0.40 | — | — | — | — | — |
| | 116 | 0.009 | 0.013 | 0.25 | 0.22 | 18.8 | 0.66 | 2.75 | 2.1 | 0.20 | 0.0004 | — | 0.71 | — | 0.17 | — | — | — | — |
| | 117 | 0.005 | 0.016 | 0.14 | 0.30 | 17.9 | 0.64 | 1.44 | 1.7 | 0.14 | 0.0007 | — | 1.56 | — | — | 0.36 | — | — | — |
| | 118 | 0.004 | 0.011 | 0.13 | 0.15 | 16.5 | 0.72 | 2.38 | 1.5 | 0.10 | 0.0010 | — | — | — | — | — | 0.25 | — | — |
| | 119 | 0.005 | 0.009 | 0.17 | 0.65 | 18.2 | 0.53 | 1.31 | 1.6 | 0.13 | 0.0010 | — | — | — | — | — | — | 1.34 | — |
| | 120 | 0.005 | 0.011 | 0.15 | 0.50 | 17.5 | 0.53 | 2.76 | 1.5 | 0.10 | 0.0008 | — | — | — | — | — | — | — | 0.0008 |
| | 121 | 0.005 | 0.016 | 0.28 | 0.66 | 18.3 | 0.64 | 1.85 | 1.7 | 0.14 | 0.0011 | 1.05 | — | 0.25 | 0.20 | 0.09 | 0.12 | 0.60 | 0.0005 |

TABLE 6

| | No. | Content of ingredients (mass %) | | | | | | | | | | | | | | | | | |
|---|---|---|---|---|---|---|---|---|---|---|---|---|---|---|---|---|---|---|---|
| | | C | N | Si | Mn | Cr | Nb | Mo | Cu | Ti | B | W | Al | Sn | V | Zr | Hf | Ta | Mg |
| Comp. ex. | 122 | 0.018 | 0.010 | 0.31 | 0.62 | 17.8 | 0.40 | 2.03 | 1.3 | 0.12 | 0.0009 | — | 0.11 | — | — | — | — | — | — |
| | 123 | 0.005 | 0.025 | 0.20 | 0.58 | 20.0 | 0.44 | 1.74 | 1.1 | 0.15 | 0.0004 | — | — | — | — | — | — | — | — |
| | 124 | 0.008 | 0.013 | 0.04 | 0.12 | 16.9 | 0.45 | 2.48 | 1.7 | 0.15 | 0.0022 | — | — | — | — | — | — | — | — |
| | 125 | 0.007 | 0.010 | 0.67 | 0.30 | 16.5 | 0.54 | 1.53 | 1.5 | 0.20 | 0.0005 | — | — | — | — | — | — | — | — |
| | 126 | 0.006 | 0.011 | 0.25 | 0.04 | 17.0 | 0.43 | 2.02 | 1.2 | 0.10 | 0.0005 | — | — | — | — | — | — | — | — |
| | 127 | 0.008 | 0.010 | 0.17 | 1.75 | 19.1 | 0.47 | 2.10 | 1.7 | 0.11 | 0.0010 | — | — | — | — | — | — | — | — |
| | 128 | 0.010 | 0.011 | 0.25 | 0.65 | 14.0 | 0.61 | 1.68 | 2.0 | 0.13 | 0.0012 | — | — | — | — | — | — | — | — |
| | 129 | 0.005 | 0.013 | 0.28 | 0.70 | 26.2 | 0.55 | 1.80 | 1.7 | 0.12 | 0.0006 | — | — | — | — | — | — | — | — |
| | 130 | 0.006 | 0.010 | 0.17 | 0.60 | 18.0 | 0.15 | 1.65 | 1.5 | 0.13 | 0.0008 | — | 0.11 | — | — | — | — | — | — |
| | 131 | 0.006 | 0.010 | 0.12 | 0.71 | 18.5 | 1.10 | 1.79 | 2.4 | 0.20 | 0.0006 | — | — | — | — | — | — | — | — |
| | 132 | 0.006 | 0.010 | 0.17 | 0.80 | 18.0 | 0.51 | 0.40 | 1.5 | 0.23 | 0.0010 | — | 0.12 | — | — | — | — | — | — |
| | 133 | 0.004 | 0.010 | 0.30 | 0.65 | 17.8 | 0.59 | 4.11 | 1.8 | 0.11 | 0.0009 | — | — | — | — | — | — | — | — |
| | 134 | 0.005 | 0.012 | 0.25 | 0.61 | 17.3 | 0.48 | 1.81 | 0.5 | 0.10 | 0.0010 | — | — | — | — | — | — | — | — |
| | 135 | 0.005 | 0.010 | 0.28 | 0.64 | 17.5 | 0.50 | 2.03 | 3.2 | 0.22 | 0.0005 | — | 0.12 | — | — | — | — | — | — |
| | 136 | 0.006 | 0.009 | 0.25 | 0.74 | 18.0 | 0.50 | 1.78 | 1.2 | 0.03 | 0.0010 | — | — | — | — | — | — | — | — |
| | 137 | 0.008 | 0.009 | 0.29 | 0.65 | 17.6 | 0.47 | 1.82 | 1.4 | 0.60 | 0.0004 | — | — | — | — | — | — | — | — |
| | 138 | 0.005 | 0.010 | 0.22 | 0.60 | 18.3 | 0.55 | 1.70 | 1.3 | 0.15 | 0.0001 | | | | | | | | |
| | 139 | 0.005 | 0.010 | 0.24 | 0.91 | 18.0 | 0.58 | 1.80 | 1.4 | 0.36 | 0.0053 | — | — | — | — | — | — | — | — |
| | 140 | 0.005 | 0.011 | 0.35 | 0.85 | 18.7 | 0.57 | 1.87 | 1.3 | 0.11 | 0.0010 | 3.46 | — | — | — | — | — | — | — |
| | 141 | 0.011 | 0.009 | 0.12 | 0.88 | 17.4 | 0.53 | 1.91 | 1.5 | 0.13 | 0.0020 | — | 3.45 | — | — | — | — | — | — |
| | 142 | 0.007 | 0.013 | 0.34 | 0.83 | 17.6 | 0.58 | 1.77 | 1.3 | 0.10 | 0.0008 | — | — | 1.15 | — | — | — | — | — |
| | 143 | 0.007 | 0.010 | 0.15 | 0.74 | 20.2 | 0.62 | 1.65 | 1.2 | 0.16 | 0.0010 | — | — | — | 1.18 | — | — | — | — |
| | 144 | 0.006 | 0.015 | 0.18 | 0.56 | 19.2 | 0.59 | 1.48 | 1.2 | 0.12 | 0.0005 | — | — | — | — | 1.30 | — | — | — |
| | 145 | 0.005 | 0.009 | 0.25 | 0.55 | 18.5 | 0.68 | 1.47 | 1.6 | 0.10 | 0.0004 | — | — | — | — | — | 1.50 | — | — |
| | 146 | 0.005 | 0.009 | 0.29 | 0.30 | 19.1 | 0.51 | 1.61 | 1.7 | 0.12 | 0.0003 | — | — | — | — | — | — | 3.05 | — |
| | 147 | 0.005 | 0.012 | 0.30 | 0.99 | 18.0 | 0.40 | 1.80 | 1.3 | 0.12 | 0.0004 | — | — | — | — | — | — | — | 0.0113 |
| | 148 | 0.005 | 0.010 | 0.30 | 0.51 | 18.1 | 0.51 | 2.35 | 1.4 | 0.11 | 0.0010 | — | — | — | — | — | — | — | — |
| | 149 | 0.007 | 0.012 | 0.20 | 0.70 | 18.5 | 0.62 | 2.10 | 1.3 | 0.15 | 0.0008 | — | — | — | — | — | — | — | — |
| | 150 | 0.005 | 0.012 | 0.30 | 0.99 | 18.0 | 0.40 | 1.78 | 0.02 | 0.12 | 0.0006 | — | — | — | — | — | — | — | — |

Thermal Fatigue Test

The obtained finished sheets were rolled into pipe shapes and the ends of the sheets were welded by TIG welding to produce 30 mmϕ pipes. Furthermore, these pipes were cut into 300 mm lengths to prepare thermal fatigue test pieces at 20 mm evaluation point intervals.

The test pieces were tested by a Servopulser type thermal fatigue test apparatus (heating method: high frequency induction heating device) wherein they were repeatedly subjected under conditions of a constraint ratio of 20% in the air to a pattern of a cycle of "raising the temperature from 200° C. to 950° C. for 150 sec→holding at 950° C. for 120 sec→lowering the temperature from 950° C. to 200° C. for 150 sec" and were evaluated for thermal fatigue life.

The "thermal fatigue life" was defined as the number of repetitions when cracks penetrated through the sheet thickness. The penetration was confirmed visually. In the evaluation, a thermal fatigue life of 1500 cycles or more was judged as passing and indicated as "+" and of less than 1500 was failing and indicated as "−".

Measurement of Nb Carbonitrides

Precipitates were sampled to allow observation of parts at ½ thicknesses of the samples of the cold rolled and annealed sheets in the normal direction of the rolling surfaces by the extraction replica method and were observed under a transmission type electron microscope (TEM). Any locations were observed under the TEM by 50000×. Tens of observed fields were captured so as to enable measurement of 300 of the Nb carbonitrides which precipitated in the grains.

The captured photographs were run through a scanner and processed to monochrome images, then the areas of the particles were found using the image analysis software "Scion Image" made by Scion Corporation. The areas were converted to circle equivalent diameters which were used as the particle sizes of the Nb carbonitrides.

The types of the precipitates were classified by quantification of the Fe, Nb, Mo, and Ti by the TEM-equipped EDS apparatus (energy dispersive spectrometer). Nb carbonitrides do not contain almost any Fe and Mo, so when the Fe and Mo are respectively less than 5 mass %, the precipitates were deemed to be Nb carbonitrides.

For evaluation of the Nb carbonitrides, Nb carbonitrides with a particle size of 0.2 μm or less present in a number ratio of 95% or more of the total Nb carbonitrides was judged as passing and indicated as "+", while of less than 95% was judged as failing and indicated as "−".

Oxidation Resistance Test

From the finished sheets, oxidation test pieces of 20 mm×20 mm and the sheet thickness as is were prepared. Continuous oxidation tests were run in the air at 950° C. for 200 hours and the presence of abnormal oxidation and scale spallation were evaluated (based on JIS Z 2281).

For the evaluation, if the amount of increase of oxidation was less than 10 mg/cm$^2$ and the amount of scale spallation was less than 5 mg, it was judged there was no abnormal oxidation and this was indicated as "+", while otherwise it was judged there was abnormal oxidation and this was indicated as "−".

Evaluation of Workability at Ordinary Temperature

JIS 13B test pieces having the directions parallel to the rolling directions as the longitudinal directions were prepared. Tensile tests were run and the elongations at break were measured. If the elongation at break at ordinary temperature is 30% or more, working into general exhaust parts is possible, so the case of having a 30% or more elongation at break was indicated as "+" and the case of less than 30% was indicated as "−".

The results of evaluation of the above tests are shown in Tables 7 and 8.

TABLE 7

| | No. | Cooling speed from annealing temperature down to 750° C. (° C./sec) | Probability of presence of 0.2 μm or larger Nb carbonitrides | 950° C. thermal fatigue life | Oxidation resistance in 950° C. 200 hr continuous oxidation test | Ordinary temp. elongation at break |
|---|---|---|---|---|---|---|
| Inv. ex. | 101 | 10 | + | + | + | + |
| | 102 | 12 | + | + | + | + |
| | 103 | 15 | + | + | + | + |
| | 104 | 10 | + | + | + | + |
| | 105 | 8 | + | + | + | + |
| | 106 | 20 | + | + | + | + |
| | 107 | 28 | + | + | + | + |
| | 108 | 17 | + | + | + | + |
| | 109 | 15 | + | + | + | + |
| | 110 | 13 | + | + | + | + |
| | 111 | 9 | + | + | + | + |
| | 112 | 12 | + | + | + | + |
| | 113 | 7 | + | + | + | + |
| | 114 | 7 | + | + | + | + |
| | 115 | 11 | + | + | + | + |
| | 116 | 9 | + | + | + | + |
| | 117 | 10 | + | + | + | + |
| | 118 | 13 | + | + | + | + |
| | 119 | 12 | + | + | + | + |
| | 120 | 8 | + | + | + | + |
| | 121 | 7 | + | + | + | + |

TABLE 8

| | No. | Cooling speed from annealing temperature down to 750° C. (° C./sec) | Probability of presence of 0.2 μm or larger Nb carbonitrides | 950° C. thermal fatigue life | Oxidation resistance in 950° C. 200 hr continuous oxidation test | Ordinary temp. elongation at break |
|---|---|---|---|---|---|---|
| Comp. ex. | 122 | 10 | − | − | − | − |
| | 123 | 12 | − | − | − | − |
| | 124 | 7 | + | + | − | + |
| | 125 | 15 | + | − | − | + |
| | 126 | 10 | + | + | − | + |
| | 127 | 7 | + | + | − | − |
| | 128 | 8 | + | − | − | + |
| | 129 | 20 | + | + | + | − |
| | 130 | 7 | + | − | + | + |
| | 131 | 16 | + | + | + | − |
| | 132 | 10 | + | − | − | + |
| | 133 | 15 | + | + | + | − |
| | 134 | 13 | + | − | + | + |

TABLE 8-continued

| No. | Cooling speed from annealing temperature down to 750° C. (° C./sec) | Probability of presence of 0.2 μm or larger Nb carbonitrides | 950° C. thermal fatigue life | Oxidation resistance in 950° C. 200 hr continuous oxidation test | Ordinary temp. elongation at break |
|---|---|---|---|---|---|
| 135 | 13 | + | − | − | − |
| 136 | 9 | + | − | + | + |
| 137 | 9 | + | − | + | − |
| 138 | 7 | + | − | + | + |
| 139 | 12 | + | − | + | + |
| 140 | 7 | + | + | + | − |
| 141 | 7 | + | + | + | − |
| 142 | 11 | + | + | + | − |
| 143 | 9 | − | − | + | − |
| 144 | 10 | + | + | + | − |
| 145 | 13 | + | + | + | − |
| 146 | 12 | + | + | + | − |
| 147 | 8 | + | + | + | − |
| 148 | 3 | − | − | + | + |
| 149 | 5 | − | − | + | + |
| 150 | 7 | + | − | + | + |

As clear from Tables 7 and 8, it could be confirmed that the invention examples comprised of the steels which were produced by a cooling speed from the final annealing temperature down to 750° C. of 7° C./sec or more, have the composition of ingredients prescribed in the present invention, and have Nb carbonitrides with a particle size of 0.2 μm or less in a number ratio of 95% or more have higher thermal fatigue lives at 950° C. compared with the comparative examples, have no abnormal oxidation or scale spallation, and were excellent in oxidation resistances as well. Further, it could be confirmed that in mechanical properties at ordinary temperature, they have excellent elongations at break and have workabilities equal to or better than the comparative examples.

Nos. 122 and 123 respectively have amounts of C and N outside the upper limits prescribed by the present invention and have sizes of Nb carbonitrides outside the upper limit. They have lower 950° C. thermal fatigue lives and oxidation resistances than the invention examples.

Nos. 124 and 126 respectively have amounts of Si and Mn outside the lower limits prescribed by the present invention. They have lower oxidation resistances than the invention examples.

No. 125 has an amount of Si outside the upper limit prescribed by the present invention. It has a lower oxidation resistance and thermal fatigue life than the invention examples.

No. 127 has an amount of Mn outside the upper limit prescribed by the present invention. It has an inferior oxidation resistance and low ductility at ordinary temperature.

Nos. 128 and 132 respectively have amounts of Cr and Mo outside the lower limits prescribed by the present invention. They have lower thermal fatigue lives and oxidation resistances than the invention examples.

No. 129 has an amount of Cr outside the upper limit prescribed by the present invention. It has a thermal fatigue life and oxidation resistance, but a low ordinary temperature ductility.

Nos. 130 and 134 respectively have amounts of Nb and Cu outside the lower limits prescribed by the present invention. They have low 950° C. thermal fatigue lives.

Nos. 131 and 133 respectively have amounts of Nb and Mo outside the upper limits prescribed by the present invention. They have high thermal fatigue lives, but low ordinary temperature ductilities.

No. 135 has an amount of Cu outside the upper limit prescribed by the present invention. It has a low thermal fatigue life and ordinary temperature ductility and inferior oxidation resistance as well.

No. 136 has an amount of Ti outside the lower limit prescribed by the present invention. It has an ordinary temperature ductility equal to the invention examples, but has a low 950° C. thermal fatigue life.

No. 137 has an amount of Ti outside the upper limit prescribed by the present invention. It has a low 950° C. thermal fatigue life and has a lower ordinary temperature ductility than the invention examples.

Nos. 138 and 139 respectively have amounts of B outside the upper limit and lower limit prescribed by the present invention. They have lower thermal fatigue lives than the invention examples.

Nos. 140 and 141 respectively have amounts of W and Al outside the upper limits prescribed by the present invention. They are high in thermal fatigue lives, but low in ordinary temperature ductilities.

Nos. 142 and 144 to 147 respectively have amounts of Sn, Zr, Hf, Ta, and Mg outside the upper limits prescribed by the present invention. They have high thermal fatigue lives, but low ordinary temperature ductilities.

No. 143 has an amount of V which is outside the upper limit prescribed by the present invention and has a size of Nb carbonitrides outside the upper limit prescribed by the present invention. It has a lower 950° C. thermal fatigue life and ordinary temperature ductility than the invention examples.

Nos. 148 and 149 are steels which have the composition of ingredients which is prescribed in the present invention, but the Nb carbonitrides with a particle size of 0.2 μm or less are in a number ratio of less than 95%. They have lower thermal fatigue lives and elongations at break than the invention examples. This is due to their being produced by a cooling speed from the final annealing temperature down to 750° C. of less than 7° C./sec, so coarsening of the Nb carbonitrides having occurred.

No. 150 is SUS444. It has an amount of Cu which is outside the lower limit prescribed by the present invention and has a low thermal fatigue life.

INDUSTRIAL APPLICABILITY

The ferritic stainless steel of the present invention is excellent in heat resistance, so can be used as exhaust gas passage materials of power plants in addition to automotive exhaust system members. Further, Mo, which is effective for improvement of the corrosion resistance, is added, so the steel can be used for applications in which corrosion resistance is required as well.

The invention claimed is:

1. A ferritic stainless steel sheet excellent in oxidation resistance comprising, by mass %, C: 0.02% or less, N: 0.02% or less, Si: over 0.10 to 0.35%, Mn: 0.10 to 0.60%, Cr: 16.5 to 20.0%, Nb: 0.30 to 0.80%, Mo: over 2.50 to 3.50%, Cu: 1.20 to 2.50%, and a balance of Fe and unavoidable impurities, wherein the ferritic stainless steel sheet has an amount of increase of oxidation after a continuous oxidation test in air at 1000° C. for 200 hours of 4.0 $mg/cm^2$ or less, and has an amount of scale spallation of 1.0 $mg/cm^2$ or less, and wherein the ferritic stainless sheet does not contain Ti.

2. The ferritic stainless steel sheet excellent in oxidation resistance as set forth in claim 1 further comprising, by mass %, at least one of W: 2.0% or less, B: 0.0030% or less, Mg: 0.0100% or less, Al: 1.0% or less, Ni: 1.0% or less, Sn: 1.00% or less, V: 0.50% or less, Zr: 1.0% or less, Hf: 1.0% or less, or Ta: 3.0% or less.

* * * * *